US009531085B2

(12) United States Patent
Miraftab et al.

(10) Patent No.: US 9,531,085 B2
(45) Date of Patent: Dec. 27, 2016

(54) MULTI-MODE FEED NETWORK FOR ANTENNA ARRAY

(71) Applicants: Vahid Miraftab, Kanata (CA); Wenyao Zhai, Kanata (CA); Halim Boutayeb, Montreal (CA)

(72) Inventors: Vahid Miraftab, Kanata (CA); Wenyao Zhai, Kanata (CA); Halim Boutayeb, Montreal (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 176 days.

(21) Appl. No.: 14/602,759

(22) Filed: Jan. 22, 2015

(65) Prior Publication Data

US 2016/0218438 A1 Jul. 28, 2016

(51) Int. Cl.

| | |
|---|---|
| ***H01Q 21/10*** | (2006.01) |
| ***H01Q 1/00*** | (2006.01) |
| ***H01Q 21/00*** | (2006.01) |
| ***H01Q 9/04*** | (2006.01) |
| ***H01Q 13/00*** | (2006.01) |

(52) U.S. Cl.
CPC ..... *H01Q 21/0075* (2013.01); *H01Q 9/045* (2013.01); *H01Q 13/00* (2013.01)

(58) Field of Classification Search
None
See application file for complete search history.

(56) References Cited

U.S. PATENT DOCUMENTS 4,415,900 A 11/1983 Kaloi
6,563,398 B1 * 5/2003 Wu ..... H01Q 21/0037 333/137
7,102,581 B1 9/2006 West
7,843,992 B2 * 11/2010 Mohamadi ..... G01S 7/032 343/850
2013/0300602 A1 * 11/2013 Zhou ..... H01Q 3/247 342/372

FOREIGN PATENT DOCUMENTS

CN 103956576 A 7/2014

OTHER PUBLICATIONS

A. Suntives and R. Abhari, Dual-Mode High-Speed Data Transmission Using Substrate Integrated Waveguide Interconnects, IEEE Conference on Electrical Performance of Electronic Packaging, Oct. 2007, pp. 215-218.
International Search Report for International Application No. PCT/CN2016/071496 mailed Mar. 16, 2016.

* cited by examiner

*Primary Examiner* — Trinh Dinh
(74) *Attorney, Agent, or Firm* — MBM Intellectual Property Law LLP

(57) ABSTRACT

A dual-mode feed network for an antenna array or combination antenna is provided. Two transmission line structures propagate signals according to two different electromagnetic propagation modes, such as TE, TM, TEM and quasi TEM modes. The two transmission line structures are operatively coupled to different components of the antenna array. One transmission line structure may be a stripline or microstrip, and the other transmission line structure may be a waveguide such as a Substrate Integrated Waveguide. Both transmission line structures may branch to reach multiple elements of the antenna array. The transmission lines may share common features, for example by embedding the stripline within the waveguide.

20 Claims, 19 Drawing Sheets

MULTI-MODE FEED NETWORK FOR ANTENNA ARRAY

CROSS-REFERENCE TO RELATED APPLICATIONS

This is the first application filed for the present technology.

FIELD OF THE INVENTION

The present invention pertains to the field of Radio Frequency (RF) front ends and in particular to feed networks employing multiple electromagnetic propagation modes for feeding antenna arrays.

BACKGROUND

Multi-band antennas and antenna arrays can be implemented using different types of antenna elements in close proximity. However, isolation of the different antenna elements from each other is generally required to improve performance of the antenna array. This can be challenging since the feed lines for the different elements of the multi-band array are also generally in close proximity. Furthermore, many existing multi-band arrays and their feed networks exhibit complex three-dimensional structures which are costly and have limited applicability.

Therefore there is a need for a feed network structure for an antenna array that is not subject to one or more limitations of the prior art.

This background information is provided to reveal information of possible relevance to the present invention. No admission is intended, nor should be construed, that any of the preceding information constitutes prior art relevant to the present invention.

SUMMARY

Embodiments of the present invention provide a multi-mode feed network for an antenna array. In accordance with an aspect of the present invention, there is provided a feed network for an antenna array, the antenna array including at least two different sets of elements. The feed network includes a first signal transmission structure coupled to antenna elements of a first set and a second signal transmission structure coupled to antenna elements of the second set. The first signal transmission structure is configured for propagating signals according to a first electromagnetic propagation mode corresponding to a Transverse Electromagnetic (TEM) mode or a quasi-TEM mode. The second signal transmission structure is configured for propagating signals according to a second electromagnetic propagation mode corresponding to one of a Transverse Electric (TE) and Transverse Magnetic (TM) mode.

In accordance with another aspect of the present invention, there is provided a method for wireless communication utilizing an antenna array which includes at least two different types of elements. The method includes propagating signals to and/or from antenna elements of a first type. The signals are propagated according to a first electromagnetic propagation mode via a first signal transmission structure. The first electromagnetic propagation mode corresponding to Transverse Electromagnetic (TEM) mode or a quasi-TEM mode. The method further includes propagating signals to and/or from antenna elements of a second type. The signals are propagated according to a second electromagnetic propagation mode via a second signal transmission structure, the second electromagnetic propagation mode corresponding to one of a Transverse Electric (TE) and Transverse Magnetic (TM) mode.

In accordance with another aspect of the present invention, there is provided a wireless device including a feed network for an antenna array including a first transmission line structure configured for propagating signals according to a first electromagnetic propagation mode corresponding to a Transverse Electromagnetic (TEM) or a quasi-TEM mode. The first transmission line structure is operatively coupled to a first set of antenna elements of the antenna array. The feed network also includes a second transmission line structure for propagating signals according to a second electromagnetic propagation mode corresponding to one of a Transverse Electric (TE) and a Transverse Magnetic (TM) mode. The second transmission line structure is operatively coupled to a second set of antenna elements of the antenna array, wherein the second set of antenna elements are different from the first set of antenna elements.

BRIEF DESCRIPTION OF THE FIGURES

Further features and advantages of the present invention will become apparent from the following detailed description, taken in combination with the appended drawings, in which.

It will be noted that throughout the appended drawings, like features are identified by like reference numerals.

DETAILED DESCRIPTION

Definitions

Figure 1:
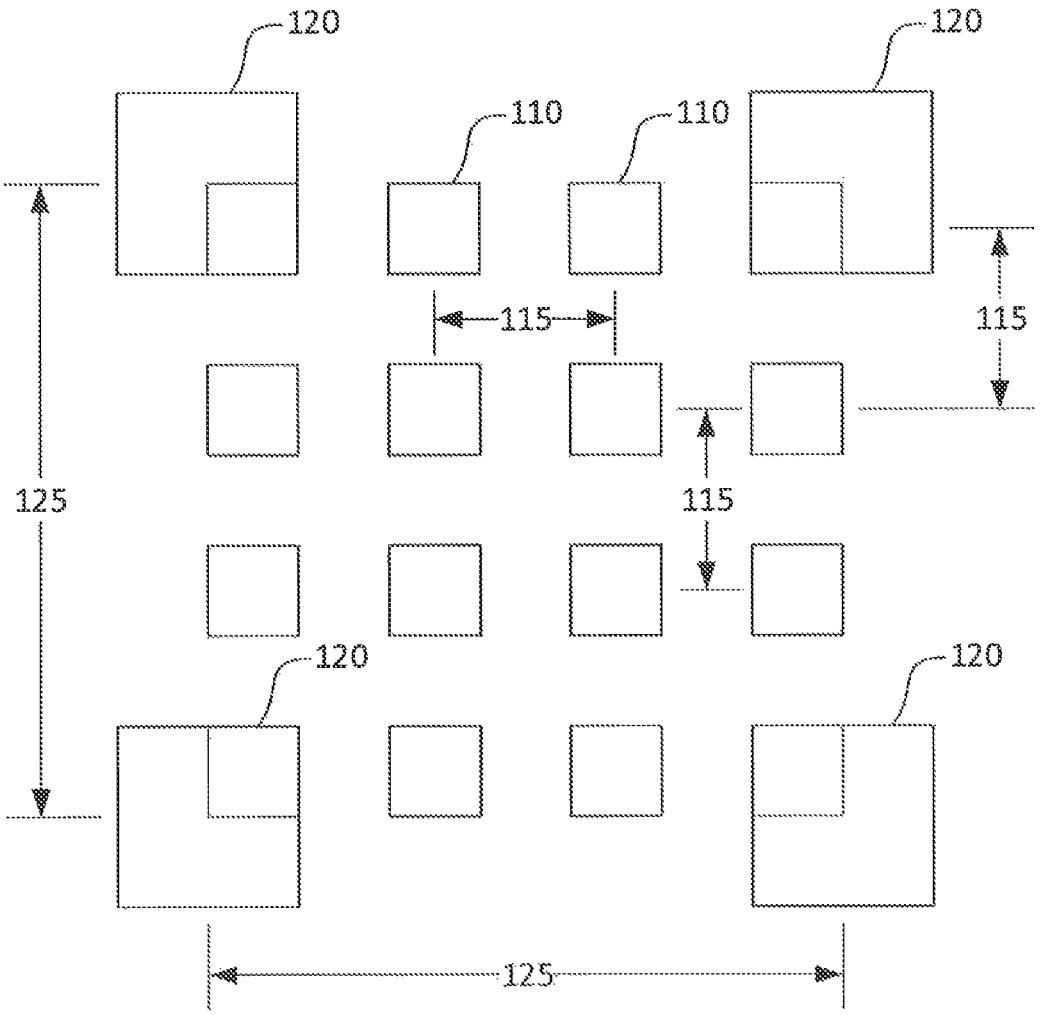
FIG. 1 schematically illustrates a dual-band antenna array provided in accordance with some embodiments of the present invention.

As used herein, the term "about" refers to a +/−10% variation from the nominal value. It is to be understood that such a variation is always included in a given value provided herein, whether or not it is specifically referred to.

Unless defined otherwise, all technical and scientific terms used herein have the same meaning as commonly understood by one of ordinary skill in the art to which this invention belongs.

Various embodiments of the present invention incorporate one or both of a waveguide structure and a multi-conductor transmission line structure, which correspond to two different types of signal transmission structures. In some embodiments, these structures are implemented using Printed Circuit Board (PCB) features. For example, the waveguide structure may include a Substrate Integrated Waveguide (SIW) and the multi-conductor transmission line structure may include a stripline, microstrip, or like structure. As will be readily understood by a worker skilled in the art, the electromagnetic propagation mode for a waveguide may be a Transverse Electric (TE) or a Transverse Magnetic (TM) mode, whereas the electromagnetic propagation mode for a multi-conductor transmission line may be a Transverse Electromagnetic (TEM) mode or a quasi-TEM mode. The use of different modes to feed different antenna elements may assist in isolating the different antenna elements from one another. For example, since a TEM mode and/or frequencies propagated by the corresponding multi-conductor transmission line is generally not sustained by a waveguide, the transmission line feed signal, and/or harmonics thereof, may be impeded from coupling onto the waveguide. Similarly, since the TE and TM modes may not be as readily sustained by a stripline, microstrip, or similar multi-conductor transmission line, the waveguide feed signal, and/or harmonics thereof, may be impeded from coupling onto the transmission line.

As used herein, the term "multi-conductor transmission line" refers to a signal transmission line such as a stripline, microstrip, coaxial cable, coplanar waveguide, or the like, as distinct from a waveguide which generally includes a single conductive conduit for directing electromagnetic energy. Various transmission lines may include a first conductor which is substantially linear or of limited cross section, and a second conductor which has a larger cross section and may operate similarly to a ground plane, the two conductors being spaced apart by a distance which facilitates signal propagation, for example in the TEM or quasi-TEM mode.

The use of a multilayer PCB-implemented waveguide and multi-conductor transmission line structures may provide for compact and cost-effective implementation, particularly when antenna elements are also implemented as features of a multilayer PCB. Furthermore, such a PCB implementation may be useful when the antenna array includes elements in a two-dimensional arrangement, such as a planar, rectangular grid pattern or a concentric circular pattern.

The signal transmission structures may, in various embodiments, be formed as appropriate conductive features of a multilayer Printed Circuit Board (PCB), such as features formed by etching of conductive layers, provision of vias, blind vias and buried vias, or the like. Such PCB implementations may be suitably compact for inclusion in wireless communication equipment, such as mobile communication terminals, handheld devices, wireless routers, mobile base stations, picocells, wireless access points, and the like, as well as being suitable for cost-effective volume production.

Aspects of the present invention provide a feed network for an antenna array and an associated method. The antenna array includes at least two different sets of antenna elements, which may be of different sizes, different types and/or operate in different frequency bands. Provided in the feed network is a first signal transmission structure, such as a multi-conductor transmission line structure, coupled to antenna elements of the first set, the first signal transmission structure being configured for propagating signals according to a first electromagnetic propagation mode, such as a Transverse Electromagnetic (TEM) mode or a quasi-TEM mode. Also provided in the feed network is a second signal transmission structure, such as a waveguide structure, coupled to antenna elements of the second set, the second signal transmission structure being configured for propagating signals according to a second, different electromagnetic propagation mode such as a Transverse Electric (TE) or Transverse Magnetic (TM) mode. The use of different propagation modes may facilitate or enhance signal isolation for the two signal transmission structures, for example within the structures, at the antenna coupling or feed points, or both.

In various embodiments, one or more antenna elements from the first set may be co-located with corresponding antenna elements of the second set to form one or more combination antenna elements. Antenna elements from the first and second sets may correspond to first and second portions of a combination antenna element, respectively. Accordingly, such combination antenna elements may be viewed as being coupled to both the first signal transmission structure and the second signal transmission structure, for example with the first and second signal transmission structures coupled to the first and second portions of the combination antenna element, respectively. At least in part in order to service the co-located antenna elements, the signal transmission structures may be integrated with each other, for example to share common features as described below.

The use of two signal transmission structures for separately feeding two sets of antenna elements may facilitate a desired impedance matching as well as a desired spacing for the corresponding antenna array. For example, each signal transmission structure may be customized to provide an efficient, impedance-matched feed for its corresponding type of antenna element, rather than attempting to match a single signal transmission structure to two different types of antenna elements.

In some embodiments, the antenna array fed by the dual-mode feed network may be a dual-band antenna array. In various embodiments of the present invention, the first frequency band in which some antenna elements of the array operate is different from the second frequency band in which other antenna elements of the array operate. In various embodiments, the two frequency bands may be separated by a large frequency difference or a small frequency difference. In some embodiments, the two frequency bands may be at least partially overlapping. The dual-mode feed network may be used to feed elements of the antenna array at these two operating frequencies. In some embodiments, the two operating frequencies correspond to a Local Multipoint Distribution Service (LMDS) frequency band, such as the 26 GHz to 31 GHz band and one or more E-band frequency bands, such as the 71 to 76 GHz band along with the 81 to 86 GHz band. In one embodiment, a representative frequency of the LMDS frequency band is about 28 GHz, and a representative frequency of the E-band is about 84 GHz. Notably the 84 GHz frequency is about three times the 28 GHz frequency, which corresponds to an integer multiple of the two representative frequencies.

In various embodiments, one or both of the first and second signal transmission structures may be branching structures, such as symmetric branching structures. For example, in order to provide a transmission line or waveguide which couples multiple antennas of an array antenna to a common signal source or destination such as an amplifier or other RF front-end component, the corresponding signal transmission structure may include at least one branching point, such as a bifurcation point, where the signal transmission structure branches or forks into a plurality of branches to provide multiple paths to and/or from the multiple antennas. The branches may terminate proximate to the points at which they couple to corresponding antenna elements.

Further, in various embodiments, the first and second signal transmission structures may share one or more common features, such as ground plane features. For example, a multi-conductor transmission line structure, such as a stripline, may be provided within an interior of a waveguide structure, such as a SIW. Consequently, the multi-conductor transmission line structure may be said to be embedded or integrated within the waveguide. As another example, a multi-conductor transmission line structure, such as a microstrip, may be provided overtop of a waveguide structure, such as a SIW, the transmission line structure using a conductive plane of the waveguide structure as its reference or ground plane structure. In either case, part or all of the waveguide structure also operates as one conductor of the multi-conductor transmission line structure. That is, one conductor of the multi-conductor transmission line corresponds to a conductive boundary of the waveguide structure. Such arrangements facilitate the interleaving and/or co-existence of the two signal transmission structures. This may facilitate a size reduction in the overall antenna array feed network. Structural portions and/or volumes occupied by the two signal transmission structures may overlap or be shared. Further, in some embodiments the integration of the two signal transmission structures may facilitate the overlapping of signal paths, so that the two signal transmission structures may be routed between common points while occupying a limited, common volume. Further, in some embodiments the integration of the two signal transmission structures may inherently allow one signal transmission structure to pass through another without necessarily having to route all of the components of one signal transmission structure overtop or underneath of the other.

When a combination antenna element is coupled to two different branches of two different transmission line structures, the branches may co-terminate. This may be the case for example when a branch of a multi-conductor transmission line structure is embedded or integrated within a branch of a waveguide.

It is noted that the paper "Dual-Mode High-Speed Data Transmission Using Substrate Integrated Waveguide Interconnects," A. Suntives and R. Abhari, IEEE Conference on Electrical Performance of Electronic Packaging, October 2007, discusses a stripline embedded inside of a substrate integrated waveguide to create a dual-mode or hybrid interconnect structure. However, in contrast to the above-mentioned paper, embodiments of the present invention provide for an application in which two signal transmission structures share common features, are coupled directly at one end to antenna elements and hence can be used for feeding or being fed by such antenna elements, and may be branching and potentially symmetric signal transmission structures. Embodiments of the present invention also provide for diplexing of different signals to and/or from different sets of elements in an antenna array, for example using power splitting and combining and potentially different frequencies of operation. The different signals may correspond to different frequency bands, such as LMDS and E-band frequency bands, rather than the same band. Further, embodiments of the present invention relate to dual-mode feeds for antenna arrays for RF, microwave and mmW applications.

It is noted that various embodiments provide for an alternative manner of feeding a dual-band antenna array. Namely, rather than using a single wideband feed network to coupled to multiple antenna elements operating at different frequencies, two interleaved and relatively narrowband feed networks may be provided.

In various embodiments, the interleaving of the two signal line transmission structures facilitates providing an antenna feed network with a desired spacing between feed points or ports. Moreover, the interleaved structure may allow for narrower port spacing than some other non-interleaved approaches. This can be beneficial for servicing antenna arrays with a specific inter-element spacing requirement, for example as in an array of mmW antenna elements spaced apart by half of an operating wavelength. One aspect which may enable the desired spacing between feed points is the reduced volume occupied by the interleaved transmission line structure when compared with two separate structures. Another aspect may be the simplified arrangement due to the reduced requirement for separate transmission line to avoid each other. Such considerations may be particularly prominent when the signal line transmission structures are provided as layers within a PCB, due to the particular layout constraints thereof.

FIG. 1 schematically illustrates a dual-band antenna array provided in accordance with some embodiments of the present invention. The antenna array includes both single-band antenna elements 110 and dual-band, combination antenna elements 120. The illustrated antenna array may be a portion of a larger antenna array. The single-band antenna elements may operate in a first frequency band while the dual-band antenna elements may each include a first sub-element operating in the first frequency band and a second sub-element operating in the second frequency band, respectively.

Spacing between the illustrated array elements may be as follows. The first frequency band includes a first representative frequency, such as a band center frequency, which is associated with a first wavelength. Likewise, the second frequency band includes a second representative frequency, such as a band center frequency, which is associated with a second wavelength. The inter-element spacing 115 between adjacent single-band antenna elements 110, as well as between adjacent single-band antenna elements 110 and dual-band antenna elements 120, may be proportional to the first wavelength. For example, the inter-element spacing 115 may be equal to about half of the first wavelength. As such, all of the antenna elements or sub-elements operating in the first frequency band are separated by a distance proportional to the first wavelength. Similarly, the inter-element spacing 125 between dual-band antenna elements 120 may be proportional to the second wavelength, for example the inter-element spacing 125 may be equal to about half of the second wavelength. As such, all of the antenna sub-elements operating in the second frequency band are separated by a distance proportional to the second wavelength. Finally, the first representative frequency may be a substantially integer multiple of the second representative frequency, and hence the second inter-element spacing 125 may be the same integer multiple of the first inter-element spacing. For example, the first frequency band may correspond to the E-band with the first representative frequency being at about 84 GHz. Likewise the second frequency band may correspond to an LMDS band with the second representative frequency being at about 28 GI-Hz. Thus the first representative frequency is about three times the second representative frequency, and the second inter-element spacing 125 is about three times the first inter-element spacing 115. As such, every fourth element in the antenna array is a combination antenna element. Other integer multiples of frequencies may be used, resulting in other array configurations. For example, if the first representative frequency were an integer k times the second representative frequency, then every $k+1^{st}$ element in the rectangular antenna array, horizontally and vertically, may be a combination antenna element. In other embodiments, the representative frequencies may be non-integer multiples of one another.

Figure 2:
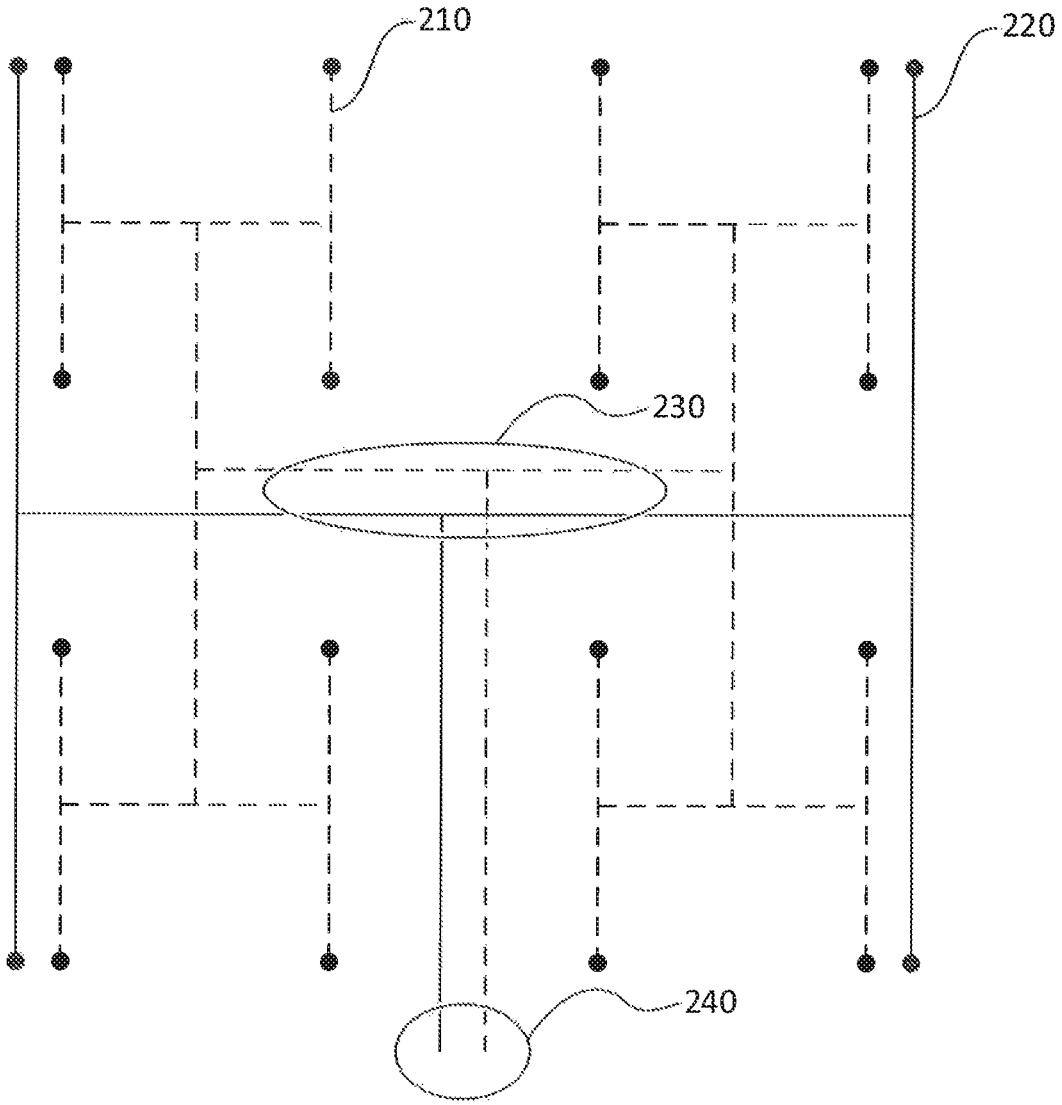
FIG. 2 illustrates first and second transmission line structures provided in accordance with one embodiment of the present invention.

FIG. 2 illustrates first and second symmetric transmission line structures 210, 220 for operative coupling to the antenna array illustrated in FIG. 1, in accordance with one embodiment of the present invention. The first transmission line structure 210 includes plural branches for coupling to both the single-band antenna elements 110 and the first sub-elements of the combination antenna elements 120. The second transmission line structure 220 includes plural branches for coupling to the second sub-elements of the combination antenna elements 120.

In the presently illustrated embodiment, the first transmission line structure 210 may be a branched multi-conductor transmission line such as a stripline, while the second transmission line structure 220 may be a branched waveguide such as a SIW. In various regions, for example at region 230, portions of the multi-conductor transmission line are co-located with corresponding portions of the waveguide. At these regions 230, the multi-conductor transmission line may share common features with the waveguide, and another conductor of the stripline may correspond to the waveguide conductor. For example, one conductor of the stripline may be routed within an interior of the waveguide. Where the multi-conductor transmission line departs from the waveguide, the departure may be facilitated by routing the conductor of the stripline through a gap formed in a sidewall of the waveguide. In the case of a SIW, this gap may be formed between two vias which function as part of a "fence" of vias forming the SIW sidewall. A root port 240 of the branched transmission line structure may be operatively coupled to other components of the RF front-end. An alternative departure of the stripline may be through an aperture formed in top or bottom of the waveguide structure using a via.

Figure 3:
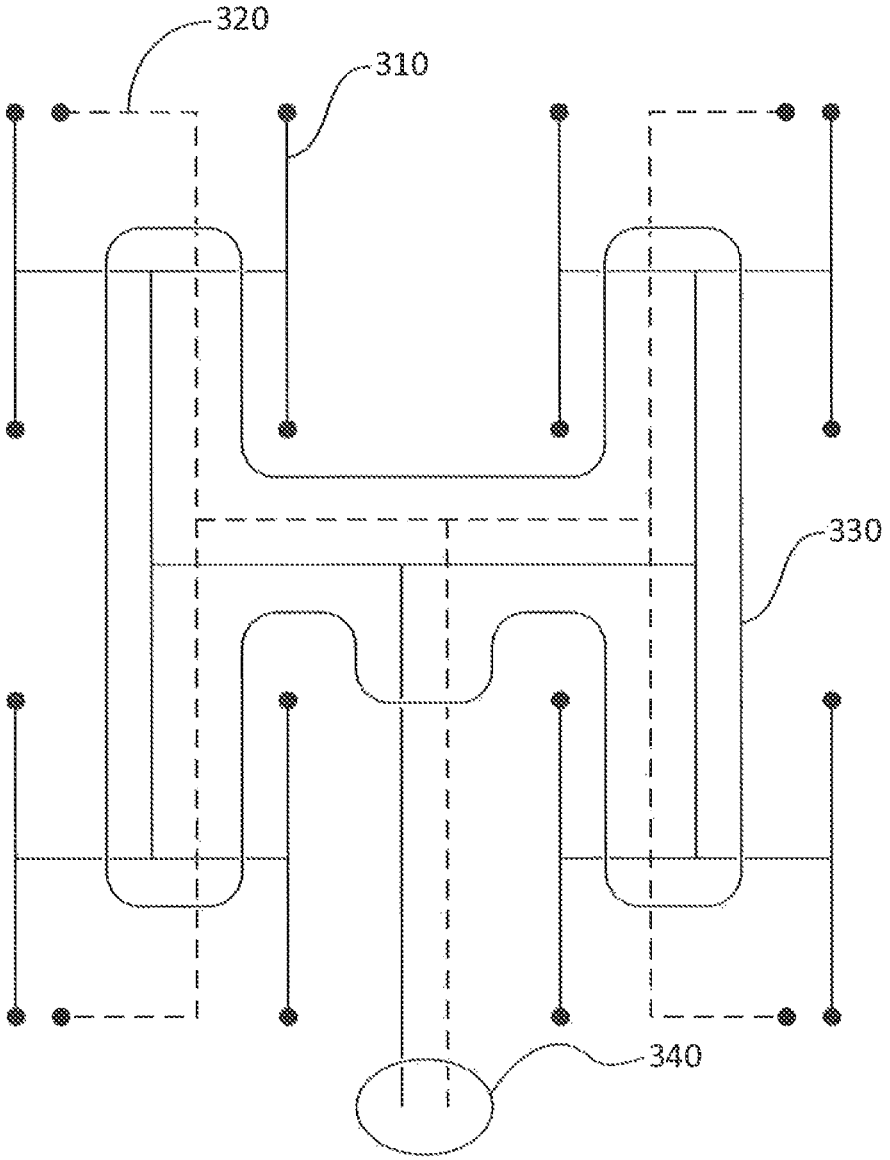
FIG. 3 illustrates first and second transmission line structures provided in accordance with another embodiment of the present invention.

FIG. 3 illustrates first and second symmetric transmission line structures 310, 320 for operative coupling to the antenna array illustrated in FIG. 1, in accordance with another embodiment of the present invention. As before, the first transmission line structure 310 includes branches for coupling to both the single-band antenna elements 110 and the first sub-elements of the combination antenna elements 120. The second transmission line structure 320 includes branches for coupling to the second sub-elements of the combination antenna elements 120. A root port 340 of the branched transmission line structure may be operatively coupled to other components of the RF front-end.

In the presently illustrated embodiment, the first transmission line structure 310 may be a branched waveguide structure such as a SIW, while the second transmission line structure 320 may be a branched multi-conductor transmission line such as a stripline. In various regions, for example at region 330, portions of the multi-conductor transmission line are co-located with corresponding portions of the waveguide. As discussed with respect to FIG. 2, at these regions 330, the multi-conductor transmission line may share common features with the waveguide.

As is apparent from a comparison of FIGS. 2 and 3, some embodiments of the present invention comprise a waveguide structure which is routed to relatively higher-frequency antenna elements with smaller inter-element spacing and a multi-conductor transmission line structure which is routed to relatively lower-frequency antenna elements with larger inter-element spacing. Other embodiments of the present invention comprise a multi-conductor transmission line structure which is routed to the relatively higher-frequency antenna elements with smaller inter-element spacing and a waveguide structure which is routed to the relatively lower-frequency antenna elements with larger inter-element spacing. In either case, the two transmission line structures each have different numbers of (potentially symmetric) branches in order to feed different numbers of antenna elements disposed in the array with different inter-element spacing or pitch. As such, a quantity of branches of one transmission line structure may be less than a quantity of branches of the other transmission line structure.

Various embodiments of the present invention provide for a pair of interleaved signal line transmission structures, each of which includes a different number of ports spatially disposed at different pitches or inter-port spacing in an array. Further, in some embodiments, some of the ports of a first one of the signal line transmission structures are co-located with some of the ports of a second one of the signal line transmission structures. Thus, some antenna elements may be fed in a dual mode manner whereas other antenna elements are fed in a single mode manner.

Figure 6A:
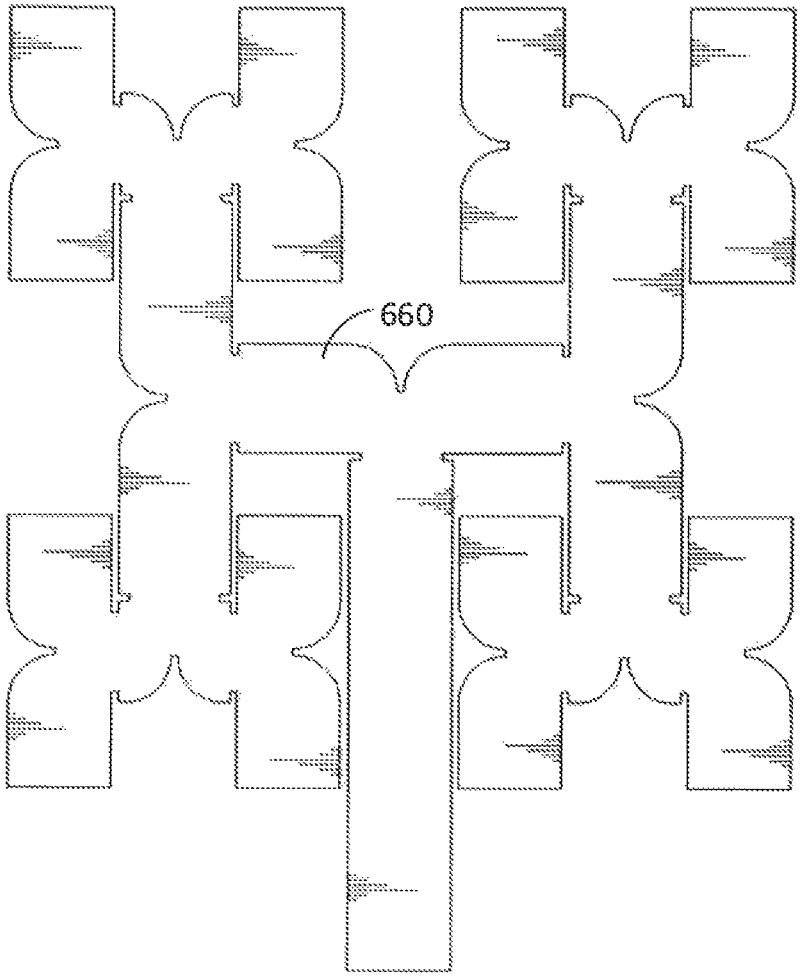
FIG. 6A illustrates a first portion of a transmission line structure which is provided in two different layers in accordance with another embodiment of the present invention.
Figure 6B:
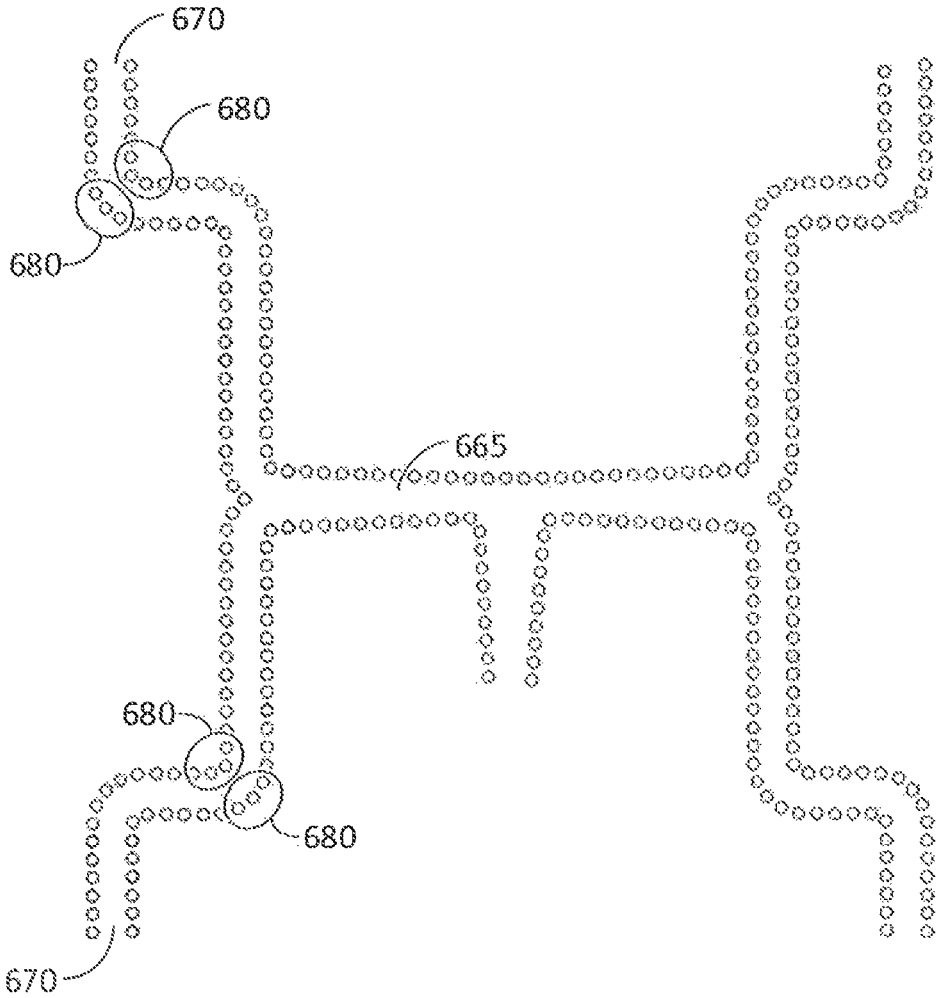
FIG. 6B illustrates second portion of a first transmission line structure wherein the vias are formed to interconnect the two different layers illustrated in FIG. 6A.
Figure 6C:
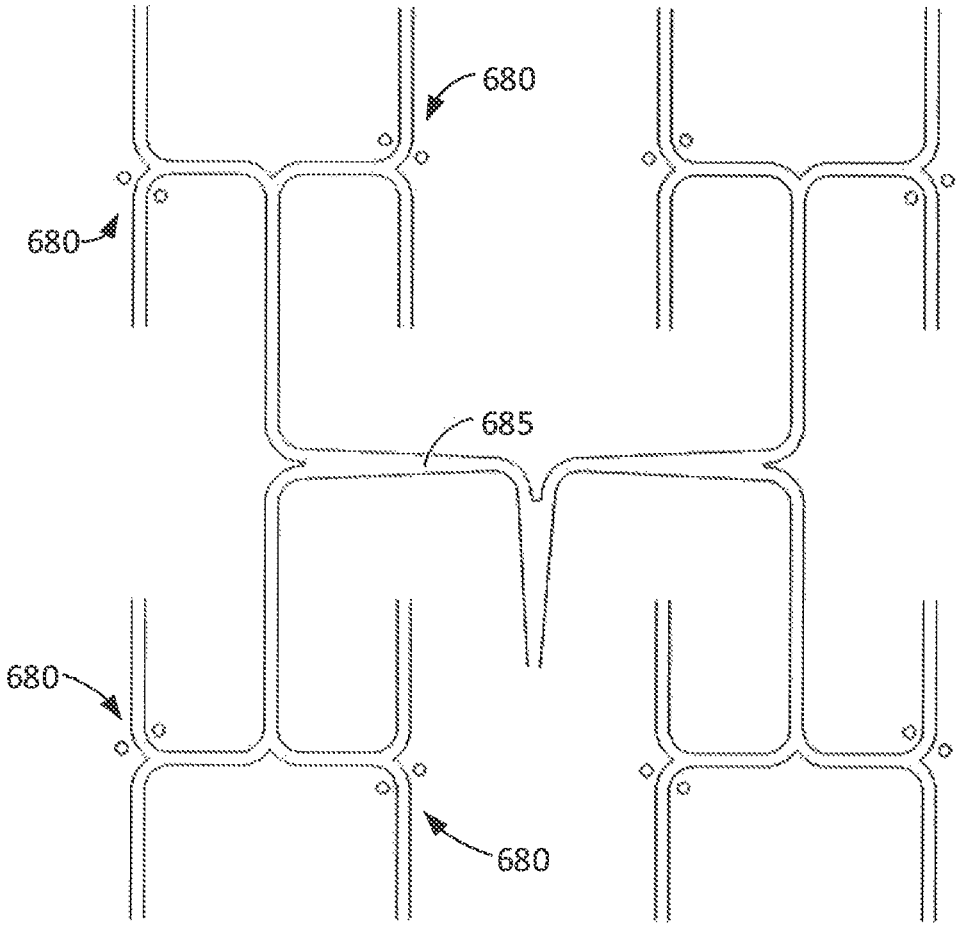
FIG. 6C illustrate a second transmission line structure provided in accordance with another embodiment of the present invention.

In some embodiments, two layers of a multilayer PCB are etched with matching branching structures which are routed in a symmetric manner to all ports to be serviced by the pair of interleaved signal line transmission structures. In one such embodiment, a further PCB layer, between or outside of the matching branching structures, is etched with a relatively narrow branching "strip" conductor which is routed in the same symmetric manner as the matching branching structures in order to provide a stripline or microstrip which is routed to all the ports. Further in this embodiment, a via fence is provided in order to implement a SIW which routes to less than all of the ports. In another embodiment, the further PCB layer is etched with a relatively narrow branching "strip" conductor which lies between the matching branching structures and is routed to less than all of the ports in order to provide the stripline or microstrip, while the via fence is provided in order to implement the SIW which routes to all of the ports. In either case, the via structure connects the edges of the matching branching structures, and in some cases may cut through interior portions of the matching branching structures when the SIW is to be routed to less than all of the ports, for example as illustrated in FIGS. 6A to 6C, which are discussed in further details herein.

Figure 4:
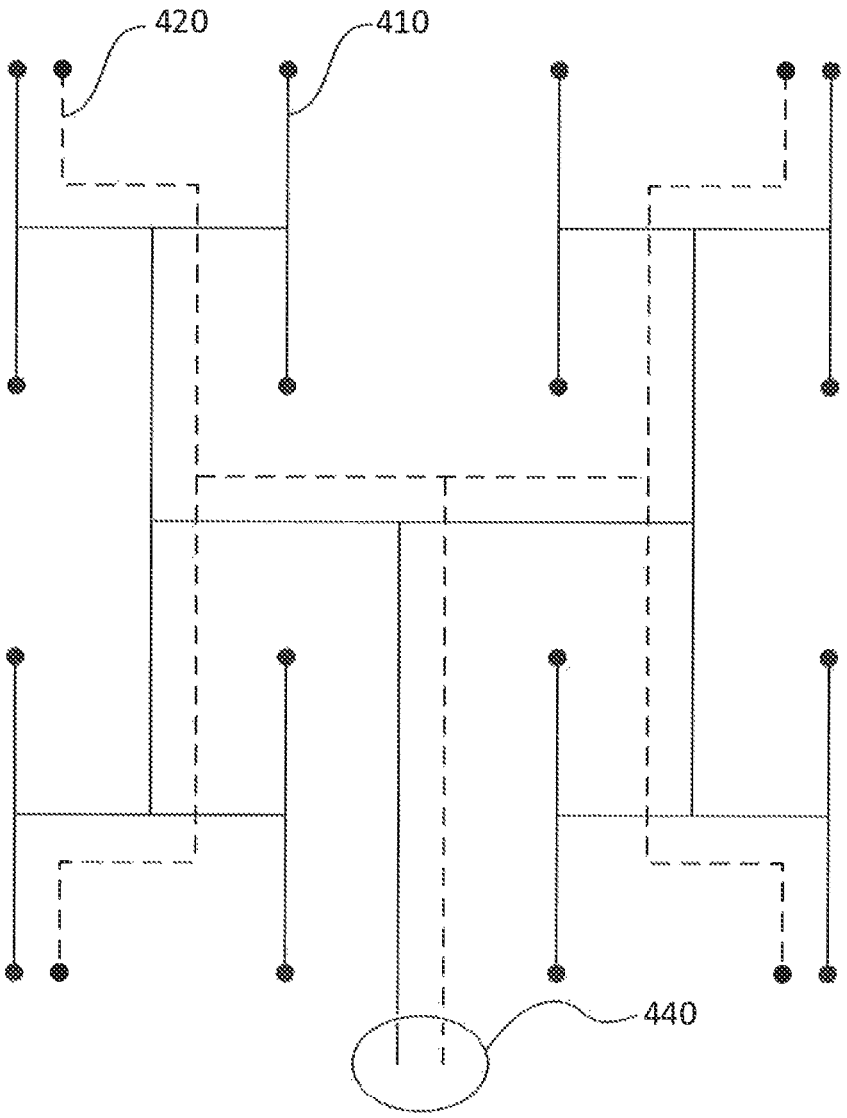
FIG. 4 illustrates first and second transmission line structures provided in accordance with another embodiment of the present invention.

FIG. 4 illustrates first and second symmetric transmission line structures 410, 420 for operative coupling to the antenna array illustrated in FIG. 1, in accordance with yet another embodiment of the present invention. Again, the first transmission line structure 410 includes branches for coupling to both the single-band antenna elements 110 and the first sub-elements of the combination antenna elements 120. The second transmission line structure 420 includes branches for coupling to the second sub-elements of the combination antenna elements 120. As with FIG. 3, the first transmission line structure 410 may be a branched waveguide structure such as a SIW, while the second transmission line structure 420 may be a branched multi-conductor transmission line such as a stripline. However, in contrast to FIG. 3, the arrangement of FIG. 4 corresponds to an arrangement in which all sections of the multi-conductor transmission line are co-located with corresponding portions of the waveguide. Such an arrangement may mitigate potential signal loss, signal reflection, signal leakage, or the like, due to routing of the transmission line away from and back to the waveguide, for example due to routing of a stripline conductor through a gap between vias in a SIW. As before, the multi-conductor transmission line may share common features with the waveguide. A root port 440 of the branched transmission line structure may be operatively coupled to other components of the RF front-end.

Figure 5:
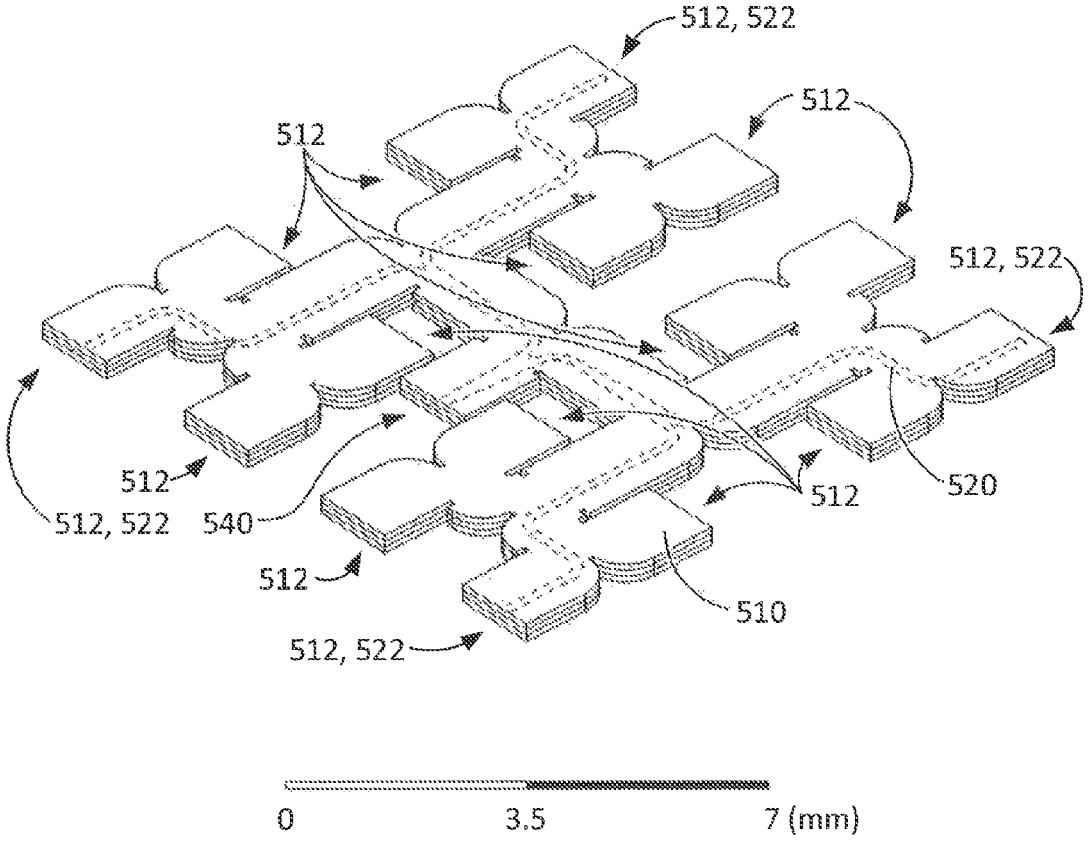
FIG. 5 illustrates first and second transmission line structures provided in accordance with another embodiment of the present invention.

FIG. 5 illustrates a perspective view of the first and second transmission line structures in accordance with an embodiment of the present invention. Similarly to FIG. 4, the first transmission line structure is a waveguide structure 510 such as a SIW, while the second transmission line structure is a branched multi-conductor transmission line structure 520 such as a stripline. Further, substantially the entire illustrated portion of the multi-conductor transmission line 520 is integrated within the waveguide structure 510. The transmission line structures may be implemented within a multilayer PCB, for example with first and second PCB layers etched with the upper and lower surfaces of the waveguide structure 510 and vias provided in the PCB at a predetermined pitch to interconnect the upper and lower surfaces, and with a third PCB layer between the first and second layers etched with a stripline conductor feature. The stripline may be centered between the upper and lower surfaces or the stripline may be an offset stripline located closer to one surface than the other. Similarly, in some embodiments the stripline may be replaced with a microstrip which is routed overtop of or underneath both the first layer and the second layer and hence outside of the SIW. A root port 540 of the branched transmission line structure may be operatively coupled to other components of the RF front-end.

The transmission line structures illustrated in FIG. 5 may also be coupled to an antenna array such as illustrated in FIG. 1. Because every fourth element in the antenna array of FIG. 1 is a combination antenna element, the transmission line structures may be formed with a substantially symmetric series of bifurcation branches. Similarly, if the antenna array is such that every $k^{th}$ element is a combination antenna element, where k is a power of 2, then a substantially symmetric series of bifurcation branches may be used. Otherwise, a different branching arrangement may be necessary. It is noted that k being a power of 2 may be appropriate when a higher representative frequency of the dual-band antenna array is one less than a power of two times a lower representative frequency. As illustrated in FIG. 5, the four terminals or ports 522 the multi-conductor transmission line structure 520 are disposed at a pitch which is about four times the pitch of the sixteen terminals or ports 512 of the waveguide structure 510.

An example of waveguide and stripline dimensions which may be appropriate for use in the transmission line structures of FIG. 5 when feeding signals in the LMDS and E-bands is as follows. The waveguide width is about 55 mils (or 1.4 mm), and the stripline width is about 6 mils (or 0.15 mm).

FIGS. 6A to 6C illustrate first and second transmission line structures provided in accordance with another embodiment of the present invention. In contrast to FIG. 5, a SIW is routed to less than all of the transmission line output ports, while a stripline is routed to all of the transmission line output ports. FIG. 6A illustrates a structure 660 to be etched on two different layers of a PCB in a matching manner. To implement the structure of FIG. 5, connecting vias would connect the entire perimeters of these matching structures, and a branching stripline structure would be routed between same. However, in the present embodiment, connecting vias are provided in the pattern illustrated in FIG. 6B, thereby implementing a branching SIW structure 665 which routes to four corner ports 670 rather than all 16 potential ports illustrated. Specifically, the via paths cut through interior portions of the structure 660. FIG. 6C illustrates a branching structure 685 to be provided on a further layer of a PCB in order to complete a branching stripline or microstrip transmission line, which is routed to all 16 ports. As illustrated, in the case of a stripline, portions of the branching structure 685 may be routed through gaps 680 in the via fence, such gaps being configured by via placement to facilitate same. Alternatively, a stripline may be diverged or exited from between the two reference planes by coupling a via to the stripline at an exit point, the via passing through an aperture in one of the reference planes.

In various embodiments, the first and second transmission line structures are substantially symmetric. For example, the path lengths from a common feed port to each antenna connection port of a provided branching transmission structure may be substantially equal. Further, the path shape from the common feed port to each antenna connection port of the provided branching transmission structure may be substantially the same. Yet further, the branching pattern and number of branchings along each path may be substantially the same. In some embodiments, one or more of the above symmetries may facilitate operating each of the antenna elements connected to the transmission line structure with substantially equal phase, for example due to substantially equal path lengths, and with substantially even power distribution between branches. It would be readily understood by a worker skilled in the art that the above use of the word substantially with respect to the terms indicative of symmetry, equality and similarity provides for a level of variation in the symmetry, equality and similarity, respectively. For example the word substantially can provide for a variation of about 5%. However, it is understood that depending on the specific requirements of the multi-mode feed network, in some instances a variation of 5% of similarity, equality or symmetry may result in an undesired level of phase error, while in other instances a variation of 5% of similarity, equality or symmetry may be acceptable. Accordingly, these further levels of variation are to be considered within the scope of the definition of the word substantially.

Some embodiments of the present invention provide for a multilayer PCB comprising a dual-mode transmission structure as described herein. The PCB may include, on multiple layers, etched conductive features corresponding to the dual-mode transmission structure, for example including a first transmission structure interleaved with a second transmission structure. The PCB may further include additional components such as patch antenna elements, waveguide antenna elements, features for coupling to other signal processing electronics, or the like, or a combination thereof.

In one embodiment, the PCB may comprise, in an example order, at least an outer layer etched with a plurality of Microstrip Patch Antenna (MPA) elements formed in an array, a first interior layer etched with an upper ground plane of a branching SIW structure, a second interior layer etched with a branching stripline structure interior to the SIW structure, and a third interior layer etched with a lower ground plane of the branching SIW structure. The PCB further comprises blind vias operatively coupling the stripline structure to the plurality of MPA elements, the vias routed through apertures formed in the upper ground plane of the branching SIW structure. Apertures can also be formed in the upper ground plane of the branching SIW structure to provide for waveguide antenna elements. Waveguide elements may be included in one or both of the combination antenna elements and the additional antenna elements. The additional antenna elements can be interleaved with the combination antenna elements. Further, buried vias can be provided for connecting the upper and lower ground planes of the branching SIW structure for provision of the SIW.

Interconnection with Antenna Elements

Several terminals of the branching feed network as described herein may each be operatively coupled to multiple antenna elements in the array in various ways. Various techniques for operatively coupling a given type of transmission line to a given type of antenna element would be readily understood by a worker skilled in the art. However, when operatively coupling a pair of integrated transmission lines to a pair of co-located antenna elements in a combination antenna element, careful consideration may be required in order to ensure each coupling is adequately functional.

Figure 7:
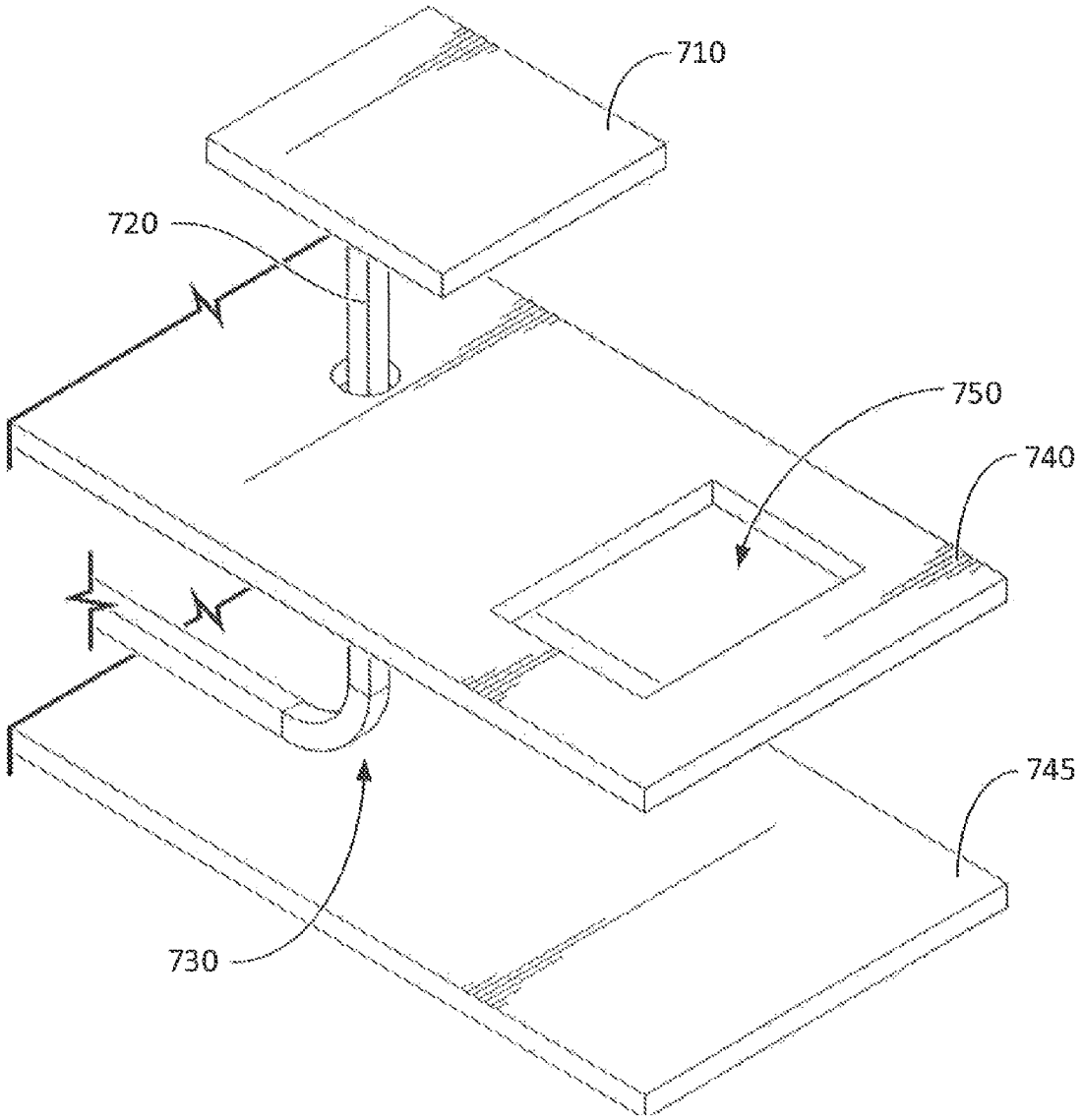
FIG. 7 illustrates interconnection between a feed network and a combination antenna element according to an embodiment of the present invention.

FIG. 7 illustrates interconnection between a feed network and a combination antenna element according to an embodiment of the present invention, wherein the vertical dimension has been greatly exaggerated for ease of reference. The feed network includes a waveguide comprising top and bottom conductive surfaces 740, 745, and a stripline 730 embedded within the waveguide. The waveguide may also be bounded on its sides, for example by a via fence (not shown) in the case of a SIW. The combination antenna element includes a waveguide antenna element 750 and a patch antenna element 710.

As illustrated, the waveguide antenna element 750 is provided at least in part by an aperture formed in the top conductive surface 740 of the waveguide. Other structural features may also be provided as part of the waveguide antenna element 750, such as vias and/or etched conductive features formed around and extending outward from the aperture, and a terminal cap of the waveguide such as a via fence.

As also illustrated, the patch antenna element 710 is disposed on a PCB layer which is separated from the waveguide and coupled to the stripline 730 using a via 720 which passes through an aperture formed in the waveguide surface. The waveguide surface may further operate as a ground or reference plane acting as a counterpoise to the patch antenna element. This may be viewed as a further benefit resulting from transmission line structure interleaving.

Interconnection with Other System Components

The feed network as described herein may be used to couple elements of an antenna array to other components of an RF front-end, such as power amplifiers, low-noise amplifiers, or the like. Such elements may be coupled to the feed network at a root port of the branched transmission line structure, for example the root ports 240, 340, 440 and 540 as illustrated in FIGS. 2 to 5, respectively. In some embodiments, each transmission structure is separated and coupled to different signal processing and/or signal generation electronics.

Figure 8:
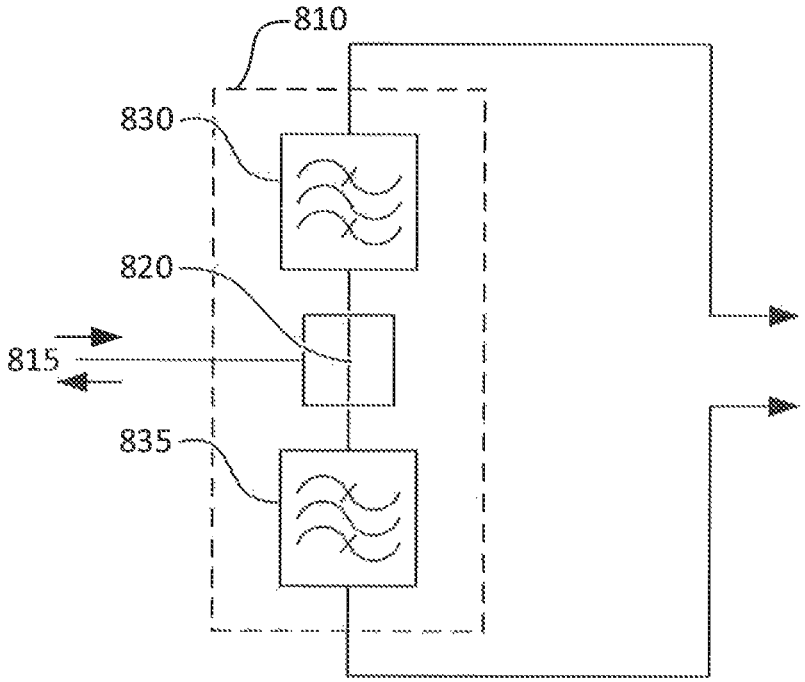
FIG. 8 illustrates a transition circuit coupled to the root of a transmission line structure in accordance with embodiments of the present invention.

FIG. 8 illustrates a transition circuit coupled to an input node of a transmission line structure comprising two integrated transmission lines, such as a stripline embedded within a SIW, in accordance with embodiments of the present invention. The transition circuit includes a diplexer 810 which is configured to receive a broadband signal 815 and bifurcate the signal for example using power divider element 820 such as a T junction. The broadband signal may be received from a common port which is associated with both of the integrated transmission lines. The diplexer 810 further includes a pair of bandpass filters 830, 835 coupled to the power divider element 820. Each of the bandpass filters is coupled to one of the transmission line structures of the antenna array feed network, and is configured to pass signal frequency components corresponding to an operating band of the antenna elements coupled at the opposite end of the transmission line structure to which it is coupled. Thus, for example, the bandpass filters may be configured to pass signal frequency components corresponding to an LMDS band and an E-band, respectively.

Other components such as impedance matching components, switches, transmit and/or receive amplifiers such as power amplifiers and low-noise amplifiers, and the like, may be coupled to the transition circuit for handling the signal transmitted thereto or received therefrom, as would be readily understood by a worker skilled in the art.

Figure 9:
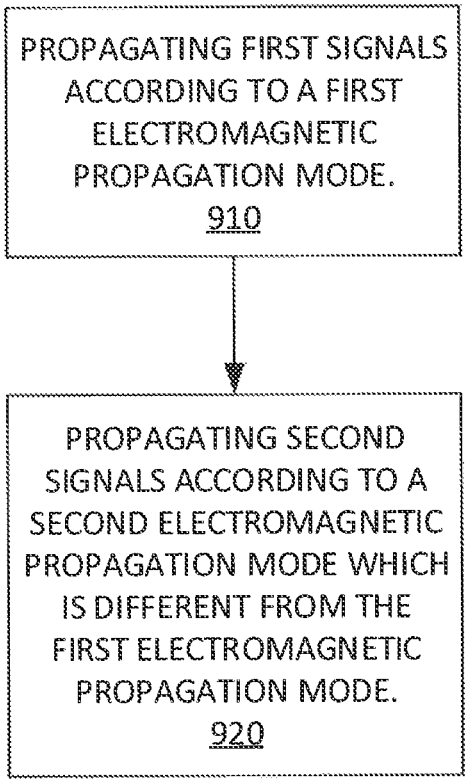
FIG. 9 illustrates a method for wireless communication, in accordance with an embodiment of the present invention.

FIG. 9 illustrates a method for wireless communication, in accordance with an embodiment of the present invention. The method includes propagating 910 first signals according to a first electromagnetic propagation mode. The signal is propagated via a first transmission line structure operatively coupled to a first set of antenna elements. The first electromagnetic propagation mode may be a TEM or quasi-TEM mode, and correspondingly the first transmission line structure may be a multi-conductor transmission line structure such as a stripline or microstrip of a PCB. The method further includes propagating 920 second signals according to a second electromagnetic propagation mode which is different from the first electromagnetic propagation mode. The second signals are propagated via a second transmission line operatively coupled to a second set of antenna elements different from the first set of antenna elements. The second electromagnetic propagation mode may be a TE or TM mode, and correspondingly the second transmission line structure may be a waveguide structure such as a SIW of a PCB. In various embodiments, the first and second signals may be propagated concurrently. Concurrent propagation may be facilitated by isolation between the different transmission line structures, for example due at least in part to mode isolation.

Figure 10A:
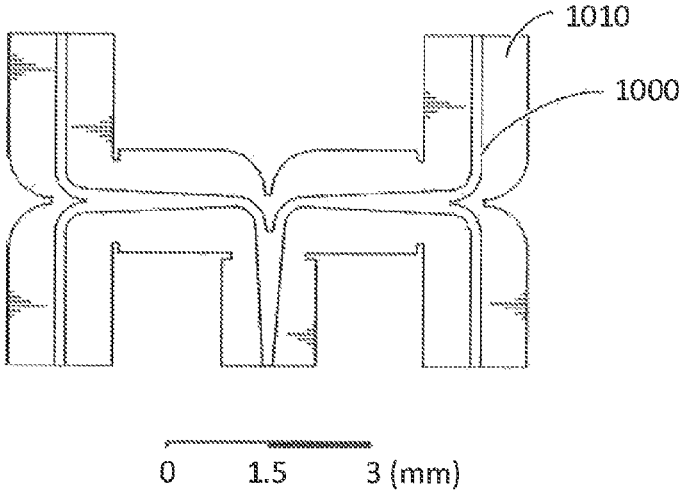
FIGS. 10A to 10F illustrate a first subsection of a branched transmission line structure and associated performance aspects, in accordance with an embodiment of the present invention.

FIG. 10A illustrates a first subsection of a branched structure including a stripline structure 1000 integrated into a SIW structure 1010, in accordance with an embodiment of the present invention. The SIW structure may be configured for transmission of signals in the E-band, while the stripline structure may be configured for transmission of signals in the LMDS band. As illustrated, all branches of the SIW structure include a corresponding branch of the stripline structure. The first subsection may form part of a branched transmission line structure, for example the center portion of the structure of FIG. 5. The SIW structure and the stripline structure may be viewed as a pair of integrated four-way power divider structures. FIGS. 10B to 10F illustrate aspects related to performance for the first subsection, including S-parameter frequency response, as derived from simulation and/or modeling of the structure.

Figure 11A:
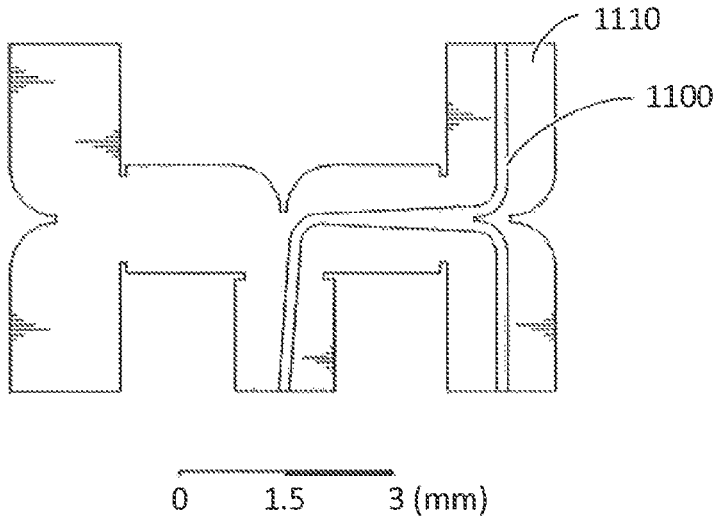
FIGS. 11A to 11F illustrate a second subsection of a branched transmission line structure and associated performance aspects, in accordance with an embodiment of the present invention.

Also visible in FIGS. 5, 10A and 11A are curves provided at branching points of the transmission line structures, which may reduce potential signal reflection. Further, the waveguide structure narrows at the branching points, which may further facilitate signal propagation due to application of an appropriate impedance matching.

Figure 10B:
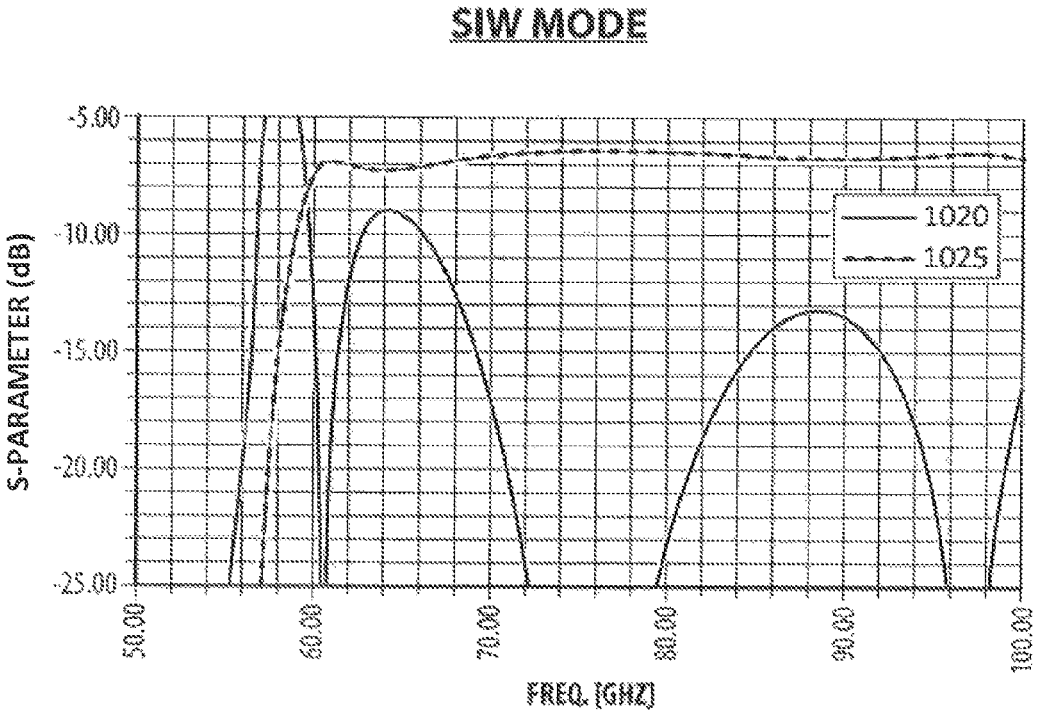

FIG. 10B graphically illustrates S-parameters for the SIW structure 1010 of FIG. 10A. A first curve 1020, which actually represents plural closely coincident curves, illustrates S21*a*, S31*a*, S41*a*, S51*a*, the transmission coefficients at each of the output ports of the SIW 4 way power divider shown in FIG. 10A, where port 1 is the input port at center bottom and ports 2 to 5 are the remaining ports. A second curve 1025 illustrates S11*a*, the reflection coefficient at the input port of the SIW 4 way power divider shown in FIG. 10A.

Figure 10C:
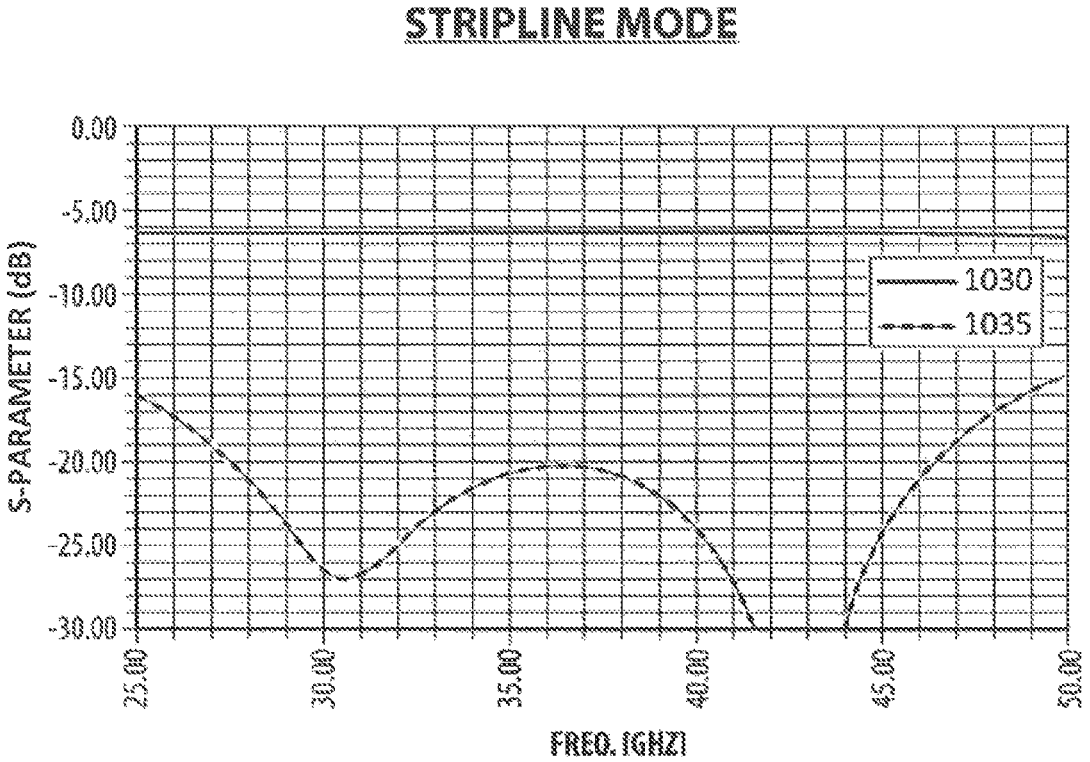

FIG. 10C graphically illustrates S-parameters for the stripline structure 1000 of FIG. 10A. A first curve 1030, which actually represents plural closely coincident curves, illustrates S21*b*, S31*b*, S41*b*, S51*b*, the transmission coefficients at each of the output ports of the stripline 4 way power divider shown in FIG. 10A, again where port 1 is the input port at center bottom and ports 2 to 5 are the remaining ports. A second curve 1035 illustrates S11*b*, the reflection coefficient at the input port of the stripline 4 way power divider shown in FIG. 10A.

Figure 10D:
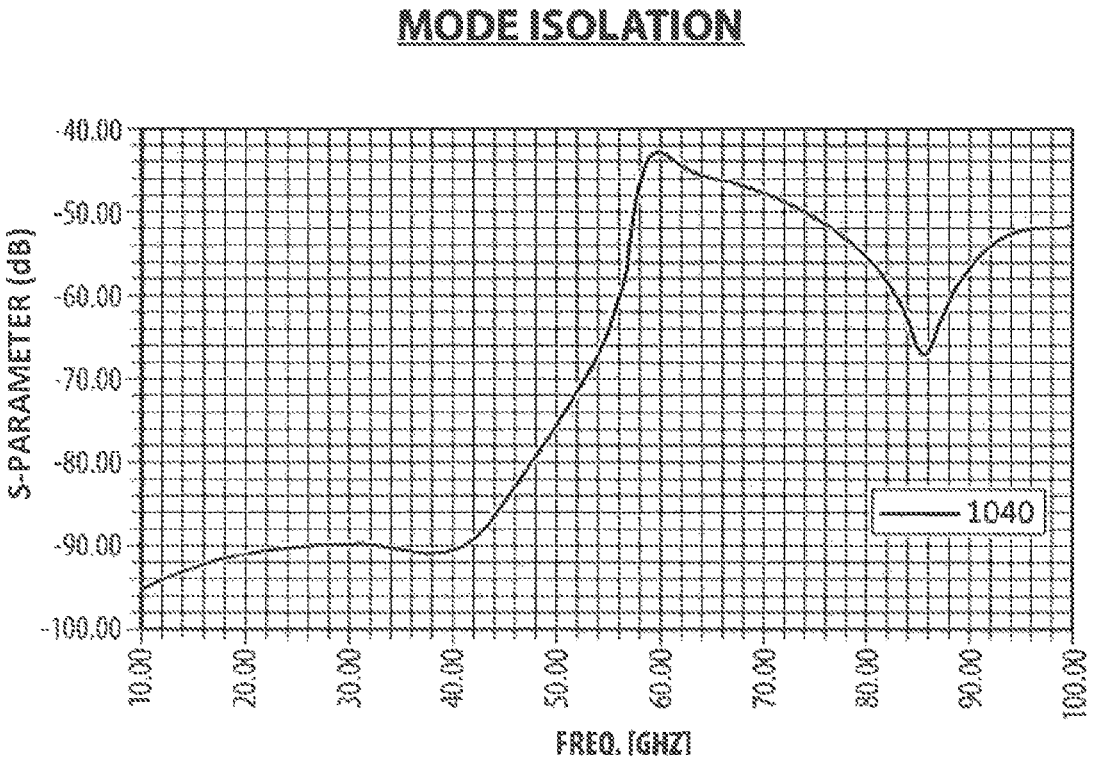

FIG. 10D graphically illustrates S-parameters indicative of mode isolation between the SIW structure 1010 and the stripline structure 1000 of FIG. 10A. A curve 1040 illustrates the coupling coefficient between the input port of the SIW transmission line and the input port of the stripline.

Figure 10E:
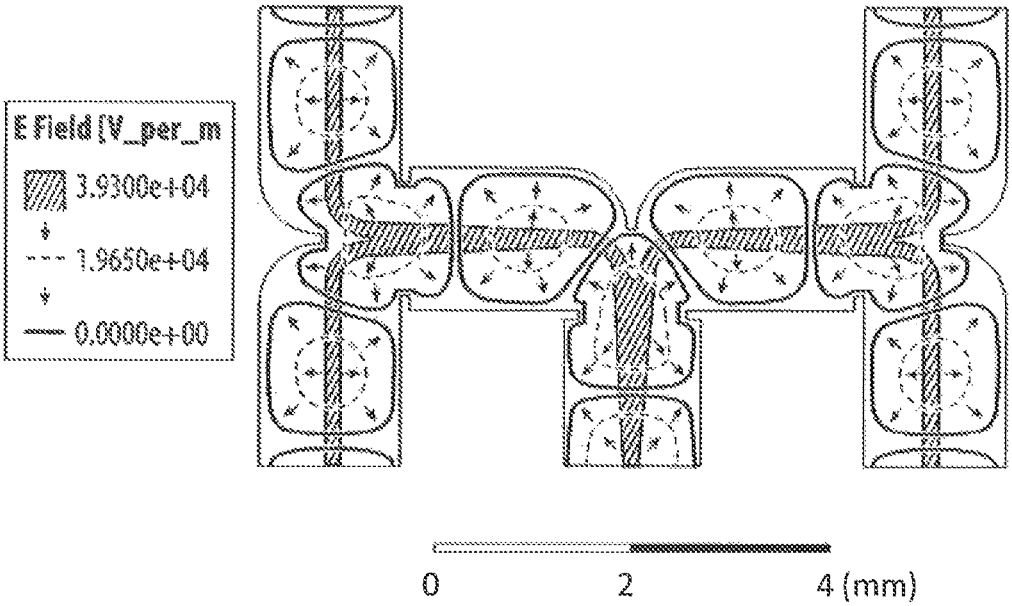

FIG. 10E illustrates the field distribution of E-band RF energy within the first subsection of the SIW. Notably, this RF energy couples substantially between all illustrated ports of the SIW.

Figure 10F:
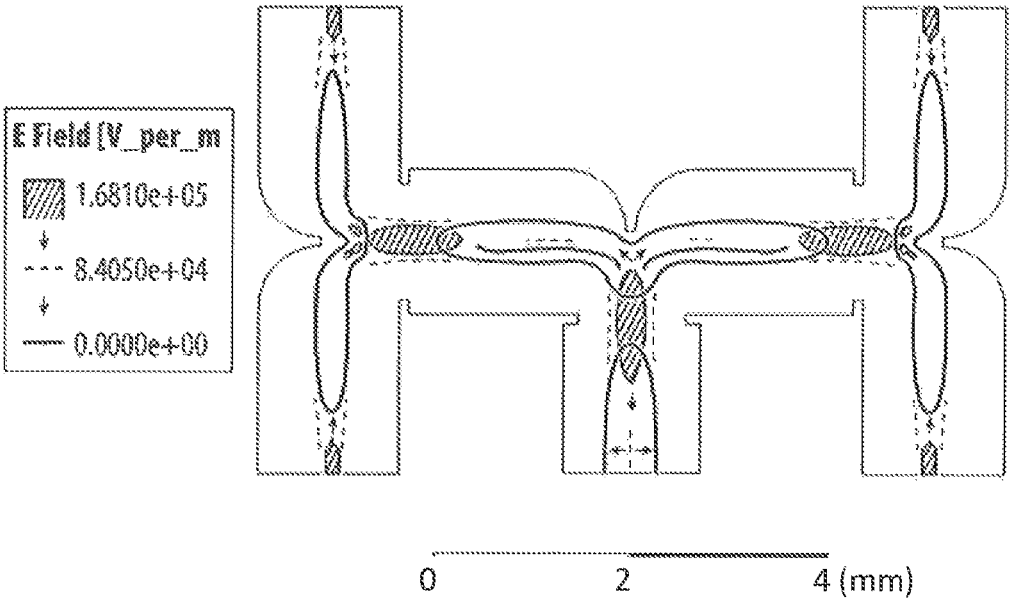

FIG. 10F illustrates the field distribution of LMDS band RF energy within the first subsection of the SIW. Notably, this RF energy is substantially confined to the vicinity of the stripline embedded within the SIW and couples substantially between all illustrated ports of the stripline.

FIG. 11A illustrates a second subsection of a branched structure including a stripline structure 1100 integrated into a SIW structure 1110, in accordance with an embodiment of the present invention. The SIW structure may be configured for transmission of signals in the E-band, while the stripline structure may be configured for transmission of signals in the LMDS band. As illustrated, and in contrast to FIG. 10, only one branch of the SIW structure includes a corresponding branch of the stripline structure. The second subsection may form part of a branched transmission line structure, for example the edge portions of the structure of FIG. 5. The SIW structure and the stripline structure may be viewed as a pair of integrated power divider structures. FIGS. 11B to 11F illustrate aspects related to performance for the first subsection, including S-parameter frequency response, as derived from simulation and/or modeling of the structure.

Figure 11B:
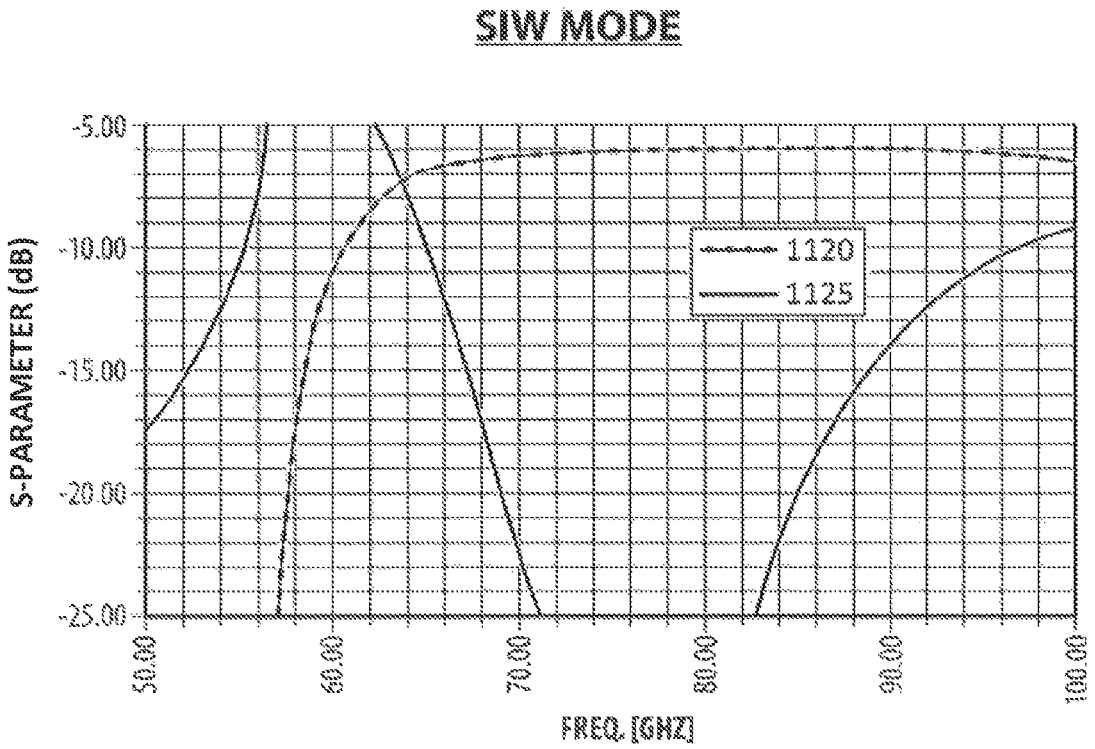

FIG. 11B graphically illustrates S-parameters for the SIW structure 1110 of FIG. 11A. A first curve 1120, which actually represents plural closely coincident curves, illustrates S21*a*, S31*a*, S41*a*, S51*a*, the transmission coefficients at each of the output ports of the SIW 4 way power divider shown in FIG. 11A, where port 1 is the input port at center bottom and ports 2 to 5 are the remaining ports. A second curve 1125 illustrates S11*a*, the reflection coefficient at the input port of the SIW 4 way power divider shown in FIG. 11A.

Figure 11C:
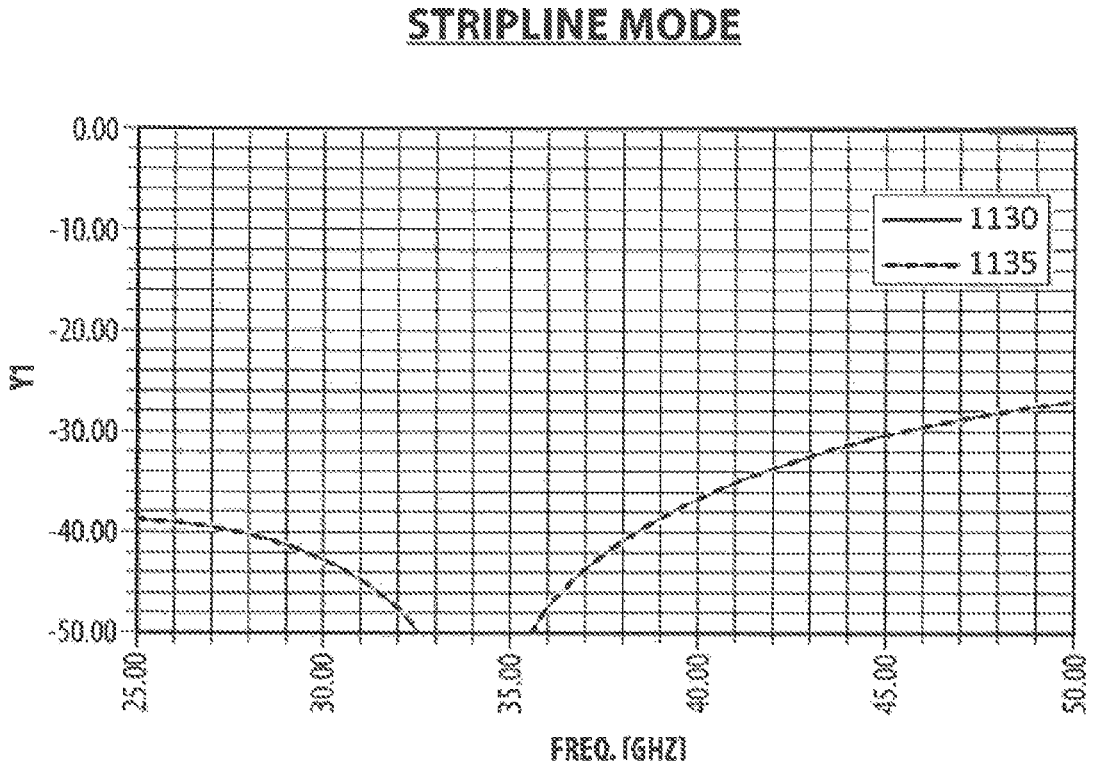

FIG. 11C graphically illustrates S-parameters for the stripline structure 1100 of FIG. 11A. A first curve 1130, which actually represents plural closely coincident curves, illustrates S21*b*, the transmission coefficient of the stripline shown in FIG. 11A. A second curve 1135 illustrates S11*b*, the reflection coefficient of the stripline shown in FIG. 11A.

Figure 11D:
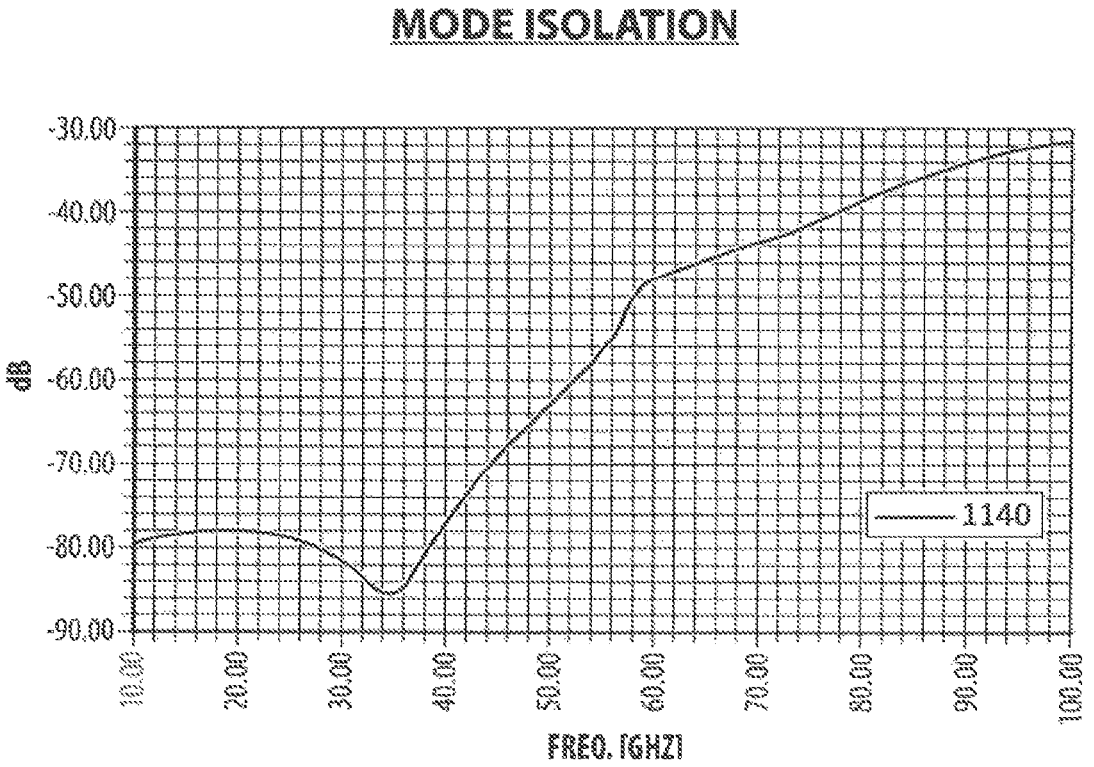

FIG. 11D graphically illustrates S-parameters indicative of mode isolation between the SIW structure 1110 and the stripline structure 1100 of FIG. 11A. A curve 1140 illustrates the coupling coefficient between the input port of the SIW transmission line and the input port of the stripline.

Figure 11E:
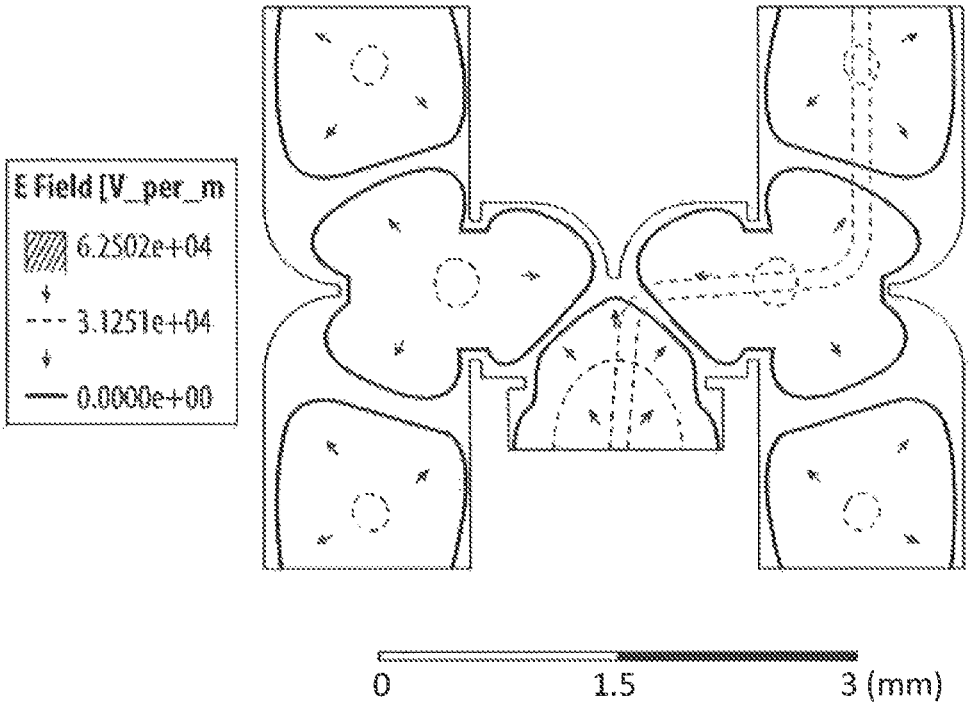

FIG. 11E illustrates the field distribution of E-band RF energy within the first subsection of the SIW. Notably, this RF energy couples substantially between all illustrated ports of the SW.

Figure 11F:
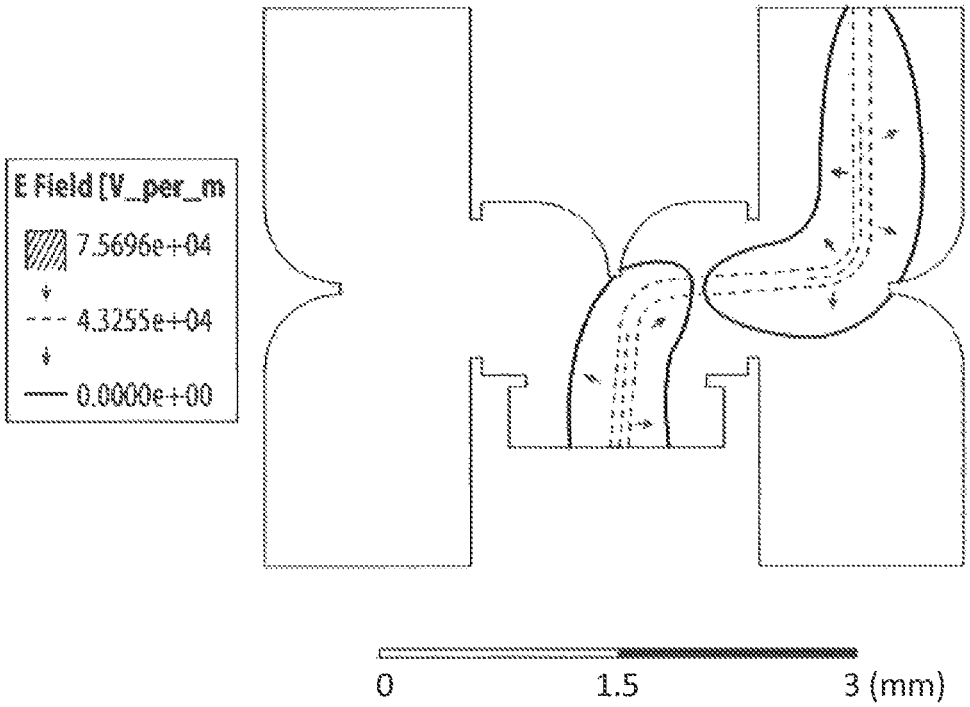

FIG. 11F illustrates the field distribution of LMDS band RF energy within the first subsection of the SIW. Notably, this RF energy is substantially confined to the vicinity of the stripline embedded within the SIW and couples substantially only between the two ports to which the stripline is routed.

Figure 12:
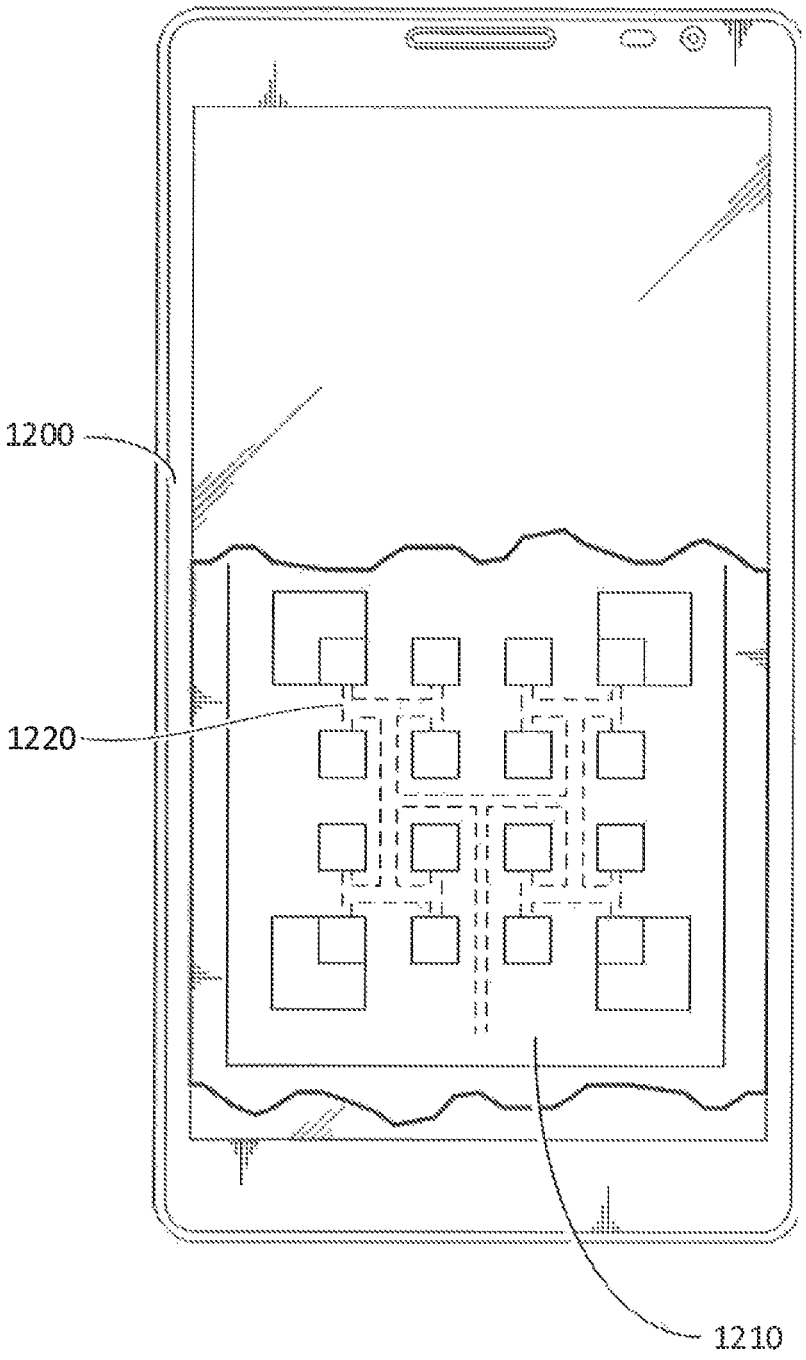
FIG. 12 illustrates a handheld wireless device comprising a dual-mode transmission line structure provided in accordance with embodiments of the present invention.

FIG. 12 illustrates a handheld wireless device 1200 comprising feed network in accordance with embodiments of the present invention. The feed network can be a dual-mode transmission line structure. The wireless device includes a PCB 1210 having an array of antenna elements and a branched, dual-mode transmission line structure 1220 operatively coupled to the array of antenna elements. The handheld wireless device 1200 may comprise various operatively interconnected electronic components which can include one or more of signal processing components, control components, RF front-end components, microprocessors, microcontrollers, memory (random access memory, flash memory or the like), integrated circuits, and the like.

Figure 13:
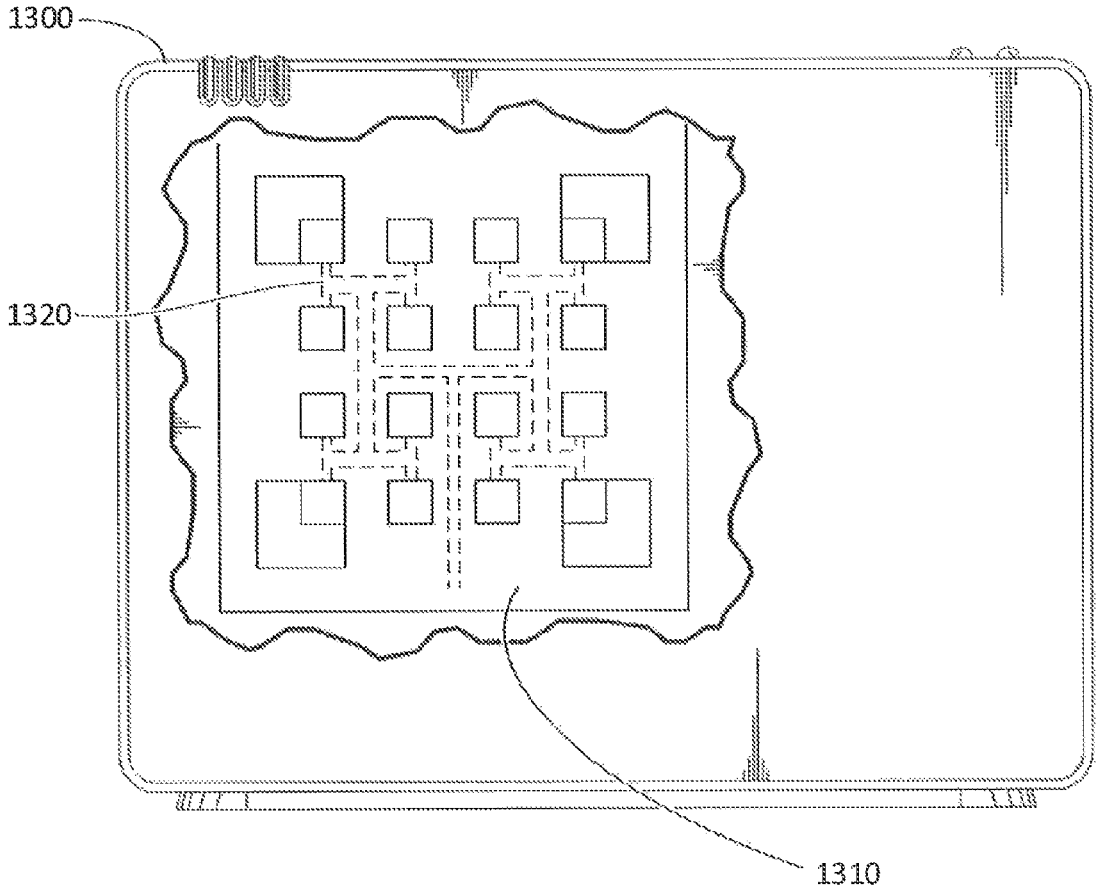
FIG. 13 illustrates a wireless router comprising a dual-mode transmission line structure provided in accordance with embodiments of the present invention.

FIG. 13 illustrates a wireless router 1300 comprising feed network in accordance with embodiments of the present invention. The feed network can be a dual-mode transmission line structure. The wireless router includes a PCB 1310 having an array of antenna elements and a branched, dual-mode transmission line structure 1320 operatively coupled to the array of antenna elements. The wireless router 1300 may comprise various operatively interconnected electronic components which can include one or more of signal processing components, control components, RF front-end components, microprocessors, microcontrollers, memory (random access memory, flash memory or the like), integrated circuits, and the like.

Although the present invention has been described with reference to specific features and embodiments thereof, it is evident that various modifications and combinations can be made thereto without departing from the invention. The specification and drawings are, accordingly, to be regarded simply as an illustration of the invention as defined by the appended claims, and are contemplated to cover any and all modifications, variations, combinations or equivalents that fall within the scope of the present invention.

We claim:

1. A feed network for an antenna array, comprising:

a first transmission line structure configured for propagating signals according to a first electromagnetic propagation mode corresponding to a Transverse Electromagnetic (TEM) or a quasi-TEM mode, the first transmission line structure operatively coupled to a first set of antenna elements of the antenna array; and a second transmission line structure for propagating signals according to a second electromagnetic propagation mode, the second electromagnetic propagation mode corresponding to one of a Transverse Electric (TE) and a Transverse Magnetic (TM) mode, the second transmission line structure operatively coupled to a second set of antenna elements of the antenna array, the second set of antenna elements different from the first set of antenna elements.

2. The feed network of claim 1, wherein the first transmission line structure is a multi-conductor transmission line structure, the second transmission line structure is a waveguide structure, and wherein one conductor of the multi-conductor transmission line corresponds to a conductive boundary of the waveguide structure.

3. The feed network of claim 2, wherein the multi-conductor transmission line structure comprises a first plurality of branches, each branch of the first plurality of branches terminating proximate to a corresponding one of the first set of antenna elements, and wherein the waveguide structure comprises a second plurality of branches, each branch of the second plurality of branches terminating proximate to a corresponding one of the second set of antenna elements, and wherein a quantity of the first plurality of branches is less than a quantity of the second plurality of branches.

4. The feed network of claim 3, wherein at least one of branch of the first plurality of branches co-terminates with at least one branch of the second plurality of branches, said least one of branch of the first plurality of branches operatively coupled to a first portion of a combination antenna element and said least one of branch of the second plurality of branches operatively coupled to a second portion of the combination antenna element, the first portion of the combination antenna element comprising an element of the first set of antenna elements and the second portion of the combination antenna element comprising an element of the second set of antenna elements.

5. The feed network of claim 2, wherein the multi-conductor transmission line structure is a stripline structure or a microstrip structure provided within a Printed Circuit Board (PCB), the waveguide structure is a Substrate Integrated Waveguide (SIW) structure provided within the PCB, the first set of antenna elements are Microstrip Patch Antenna elements and the second set of antenna elements are waveguide antenna elements corresponding at least in part to apertures formed in the SIW structure.

6. The feed network of claim 1, wherein the first transmission line structure comprises a first plurality of branches, each branch of the first plurality of branches coupled to a corresponding one of the first set of antenna elements, and wherein the second transmission line structure comprises a second plurality of branches, each branch of the second plurality of branches coupled to a corresponding one of the second set of antenna elements.

7. The feed network of claim 1, wherein at least one of the first set of antenna elements is combined with at least one of the second set of antenna elements to form a corresponding combination antenna element fed by both the first transmission line structure and the second transmission line structure.

8. The feed network of claim 1, wherein the first transmission line structure is a multi-conductor transmission line structure.

9. The feed network of claim 8, wherein the multi-conductor transmission line structure is a stripline structure or a microstrip structure provided within a Printed Circuit Board.

10. The feed network of claim 1, wherein the second transmission line structure is a waveguide structure.

11. The feed network of claim 10, wherein the waveguide structure is a Substrate Integrated Waveguide structure provided within a Printed Circuit Board.

12. The feed network of claim 1, further comprising a diplexer for coupling the first transmission line structure and the second transmission line structure to a common port.

13. The feed network of claim 1, wherein at least one of the first transmission line structure and the second transmission line structure comprises a plurality of symmetric branches.

14. The feed network of claim 13, wherein the plurality of symmetric branches provide a corresponding plurality of paths from a common port to a respective plurality of antenna ports, said plurality of paths having substantially equal lengths.

15. A method for wireless communication, comprising:

propagating signals according to a first electromagnetic propagation mode via a first transmission line structure operatively coupled to a first set of antenna elements, the first electromagnetic propagation mode corresponding to a Transverse Electromagnetic (TEM) or a quasi-TEM mode; and propagating signals according to a second electromagnetic propagation mode via a second transmission line structure operatively coupled to a second set of antenna elements different from the first set of antenna elements, the second electromagnetic propagation mode corresponding to one of a Transverse Electric (TE) and a Transverse Magnetic (TM) mode.

16. The method of claim 15, wherein the first transmission line structure is a multi-conductor transmission line structure, the second transmission line structure is a waveguide structure, one conductor of the multi-conductor transmission line corresponds to a conductive boundary of the waveguide structure, and wherein propagating the signals via the first transmission line structure is performed concurrently with propagating the signals via the second transmission line structure.

17. The method of claim 15, wherein the first transmission line structure comprises a first plurality of branches, each branch of the first plurality of branches coupled to a corresponding one of the first set of antenna elements, and wherein the second transmission line structure comprises a second plurality of branches, each branch of the second plurality of branches coupled to a corresponding one of the second set of antenna elements, wherein propagating the signals via the first transmission line structure comprises propagating the signals along the first plurality of branches, and wherein propagating the signals via the second transmission line structure comprises propagating the signals along the second plurality of branches.

18. The method of claim 15, further comprising diplexing a broadband signal onto the first transmission line structure and the second transmission line structure.

19. A wireless device comprising:

a feed network for an antenna array including a first transmission line structure configured for propagating signals according to a first electromagnetic propagation mode corresponding to a Transverse Electromagnetic (TEM) or a quasi-TEM mode, the first transmission line structure operatively coupled to a first set of antenna elements of the antenna array and the feed network including a second transmission line structure for propagating signals according to a second electromagnetic propagation mode, the second electromagnetic propagation mode corresponding to one of a Transverse Electric (TE) and a Transverse Magnetic (TM) mode, the second transmission line structure operatively coupled to a second set of antenna elements of the antenna array, the second set of antenna elements different from the first set of antenna elements.

20. The wireless device according to claim 19, wherein the wireless device is a hand held wireless device or a wireless router device.

* * * * *